US005890865A

United States Patent [19]

Smith et al.

[11] Patent Number: 5,890,865

[45] **Date of Patent: *Apr. 6, 1999**

[54] AUTOMATED LOW PROFILE REFUSE VEHICLE

[75] Inventors: Fred T. Smith; Fred P. Smith, both of Alpine; William Johnson, Vernal, all of Utah; Larry D. Horning, Crestline, Ohio

[73] Assignee: McClain E-Z Pack, Galion, Ohio

[ * ] Notice: The term of this patent shall not extend beyond the expiration date of Pat. No. 5,470,187.

[21] Appl. No.: 562,394

[22] Filed: Nov. 24, 1995

Related U.S. Application Data

[63] Continuation-in-part of Ser. No. 482,031, Jun. 7, 1995, Pat. No. 5,601,392, which is a continuation of Ser. No. 118,564, Sep. 9, 1993, Pat. No. 5,470,187.

[51] Int. Cl.[6] ..... B65F 3/02

[52] U.S. Cl. ..... 414/408; 414/786

[58] Field of Search ..... 414/406–408, 414/303, 786, 486

[56] References Cited

U.S. PATENT DOCUMENTS

| | | | |
|---|---|---|---|
| 3,572,529 | 3/1971 | Anderson | 414/408 |
| 3,765,554 | 10/1973 | Morrison | 414/408 |
| 3,827,587 | 8/1974 | Liberman et al. | 414/408 X |
| 3,841,508 | 10/1974 | Ebeling et al. | 414/406 |
| 4,057,156 | 11/1977 | Thompson et al. | 414/408 |
| 4,085,857 | 4/1978 | Smith | 414/408 |
| 4,091,944 | 5/1978 | Gollnick | 414/408 X |
| 4,175,903 | 11/1979 | Carson | 414/408 |
| 4,538,951 | 9/1985 | Yeazel et al. | 414/407 |
| 4,566,840 | 1/1986 | Smith | 414/408 |
| 4,715,767 | 12/1987 | Edelhoff et al. | 414/408 |
| 4,844,682 | 7/1989 | Edelhoff | 414/408 |
| 4,986,074 | 1/1991 | Hahmann et al. | 414/408 X |
| 5,033,930 | 7/1991 | Kraus | 414/408 |
| 5,049,026 | 9/1991 | Bingman et al. | 414/408 |
| 5,064,332 | 11/1991 | Edelhoff et al. | 414/408 |
| 5,114,304 | 5/1992 | Edelhoff et al. | 414/786 |
| 5,203,669 | 4/1993 | Klassek et al. | 414/525.2 |
| 5,222,853 | 6/1993 | Carson | 414/408 |
| 5,330,308 | 7/1994 | Armando et al. | 414/408 |
| 5,484,245 | 1/1996 | Zopf | 414/406 X |
| 5,551,824 | 9/1996 | Zanzig et al. | 414/406 X |

OTHER PUBLICATIONS

10–Solenoid–Valve Control Stick Gives Truck Operator "Extra Hands", publication, pp. 118–122, by E.C. Copeland, Hydraulics & Pneumatics, vol. 29, No. 9, Sep. 1976.

Digitrak . . . advanced electronic motion control for opening and closing valves, publication edited by applicant.

Peabody–Galion "Flex Arm" Model FL80–HC3323 front-loader with folding arms, photograph submitted by applicant.

*Primary Examiner*—David A. Bucci

*Attorney, Agent, or Firm*—Niro, Scavone, Haller & Niro

[57] ABSTRACT

An automated device for lifting and loading materials employs a pick-up arm for engaging material at ground level and an associated, inverted U-shaped lift arm. The pick-up arm can be swung relative to the lift arm about a vertical axis to bring the pick-up arm into a close-in position in front of a cab and into an outreaching position. The pick-up arm is automatically moved into the outreaching position as the lift arm moves toward a ground-level load position and is automatically moved into the close-in position as the lift arm moves toward the off-load level above ground to facilitate off-loading operations above ground. When moved closer toward the off-load position, the pick-up arm is automatically vertically tipped to facilitate off-loading operations. During off-loading operations, the vertical height of the container and lift arm assembly is minimized through the use of a dump link and associated four-bar linkage. The lift arm can also be pivoted between positions adjacent the cab and positions angularly spaced to one side of the cab. The lift assembly and pick-up arm operations can be controlled by a single operator seated within an unmodified (full) cab using a single control lever.

15 Claims, 34 Drawing Sheets

AUTOMATED LOW PROFILE REFUSE VEHICLE

This application is a continuation-in-part of U.S. Ser. No. 08/482,031, filed Jun. 7, 1995 now U.S. Pat. No. 5,601,392, which is a continuation of U.S. Ser. No. 08/118,564, filed Sep. 9, 1993, now U.S. Pat. No. 5,470,187.

BACKGROUND OF THE INVENTION

The invention generally relates to systems and apparatus for lifting and loading materials into storage containers. The invention more particularly relates to an automated vehicular system and apparatus for the collection of waste materials.

In many environments, there is a need to efficiently lift and load large volumes of materials. The collection of waste materials is a good example of one such environment.

The use of curbside waste collection containers is becoming more and more widespread. In this arrangement, waste materials are accumulated by a household in specially designed plastic or metal containers. The refuse crew empties the contents of these containers into waste collection vehicles using specially designed lifting and loading assemblies. By using these relatively large collection containers in association with specially designed lifting and loading assemblies, large volumes of waste materials can be collected in a given period of time, compared to conventional hand-loading operations.

Lifting and loading mechanisms that engage the container in the front of the waste collection vehicle ("frontloaders") are in common use. These mechanisms conventionally have two curved arms that clear the cab in front of the vehicle and a pair of forks that fit into side or bottom pockets of a steel collection container. Other mechanisms employ a triangular frame in front of the cab that locks into a triangular pocket on the rear face of a plastic collection container. Use of these mechanisms is limited, however, because they can only lift a container located directly in front of the vehicle.

Another example of a lifting assembly is shown in U.S. Pat. No. 4,715,767 to Edelhoff et. al. Edelhoff discloses a lift arm arranged to pick-up the containers along the side of the cab. This provides the operator with greater flexibility and speed in waste collection operations.

One objective of this invention is to provide a lifting and loading apparatus that is compact and readily adaptable for use in association with a chassis-mounted collection system where tare weight and weight distribution considerations are important.

Another objective of this invention is to provide an automated refuse vehicle of the "frontloader" variety that is "low profile" in the sense that the lift arm does not exceed a relatively low, predetermined height "envelope" during lifting and dumping of the container.

Another objective of this invention is to provide lifting and loading apparatus that performs all primary operations with a single control lever.

Yet another objective of this invention is to provide an automated lifting and loading apparatus that can readily accommodate both front and side pick-up operations.

Still another objective of this invention is to provide a lifting and loading apparatus that provides an unobstructed view of the work station from the left-hand side of the cab, thereby eliminating the need for a right-hand drive station in the cab, and permitting the use of a conventional, unmodified cab.

Still Other objects will be recognized once the present invention, as described below, is understood.

SUMMARY OF THE INVENTION

The present invention preserves the known advantages of prior art transportable vehicular lifting and loading systems and apparatus. In addition, it provides new advantages not found in such currently available systems and apparatus and overcomes many of the disadvantages of such currently available devices, including those discussed above.

A preferred embodiment of the present invention is directed to a low profile refuse collection vehicle for lifting, tilting and dumping a material collection container. The vehicle has a chassis or frame and a cab, and a storage container is mounted on the chassis rearward of the cab. The storage container has an inlet opening located at its front end. A pick-up arm is used to engage a refuse collection container, and a lift arm is operably engaged to the pick-up arm. The lift arm is mounted rearward of the cab at a first end portion and connected at a second end portion to the pick-up arm. A first powered actuator rotates the lift arm about a horizontal axis to move the pick-up arm upwardly and rearwardly relative to the storage container between a load position, at which the pick-up arm is located near ground level, and an off-load position, in which the pick-up arm is moved to a level adjacent the inlet opening. The lift arm assembly is preferably mounted to the storage container. A second powered actuator pivots the pick-up arm about a vertical axis. A front link assembly rotatably associated with a front portion of the lift arm links the lift arm with the pick-up arm. The front link assembly operates to decrease the effective lift arm length during tilting and dumping of the container, and can operate to increase the effective lift arm length during container movement between a load position and a position at about cab height. The container movement between load and off-load positions defines a container path which is non-circular.

In a particularly preferred embodiment, the front link can include a front link arm pivotally connecting a first front portion of the lift arm to a dump link, and a stabilizer arm pivotally connecting a second front portion of the lift arm to the dump link. The front link and stabilizer arms form a fourbar linkage which permits the collection container to be rotated relative to the lift arm and facilitates tilting and dumping of the container.

In a preferred embodiment, the pick-up arm can rotate about a vertical axis passing through the dump link. An engaging mechanism, such as grippers, can be operably disposed on the pick-up arm for engaging and holding the collection container, and a third powered actuator can be used to move the engaging mechanism with respect to the pick-up arm to a position for engaging the collection container.

Also in a preferred embodiment, the cab and the storage container each are of substantially equal and coextensive width, and the lift arm is in the form of an inverted "U" with two generally parallel sides that surround the cab when the lift arm is in a load position. The collection container can be engaged when in a position forward of and laterally displaced from the cab, and the second end portion of the lift arm can be located forward of the cab when the lift arm is in the load position.

In another preferred embodiment, a single control lever can be moved to a variety of positions to permit an operator to control movements of the both the lift and pick-up arms. Preferably, pivoting of the pick-up arm about a vertical axis occurs simultaneously and in synchronistic relationship with the upward and rearward movement of the lift arm. A mechanism can also be provided for selectively disabling the rotational movement of the pick-up arm about the vertical axis.

In an alternative embodiment, a speed control mechanism operably engaged to the pick-up arm can be provided to permit the collection container to smoothly accelerate during movement of the pick-up arm between an outreaching position generally coplanar with the lift arm, and an intermediate position between the outreaching position and a close-in position in which the pick-up arm is generally normal to the lift arm. This mechanism can also permit the collection container to smoothly decelerate during movement of the pick-up arm between the intermediate and the close-in positions.

The power actuators for the lift and pick-up arms, as well as the front link assembly and engaging mechanism, can be powered by hydraulic cylinders (e.g., "master" and "slave" cylinders) using fluid pressure provided within a hydraulic system. In this embodiment, pressure-compensated flow control valves associated with the hydraulic cylinders can be used to ensure that the fluid flow within each of the hydraulic cylinders, for a given position of the single control lever, remains constant regardless of external loading being applied to the system. In an alternative embodiment, continuous regeneration means can be used to permit the lift arm to be operated in at least first and second modes, with the lift arm while in the first mode being capable of moving the container twice as fast as when in the second mode. Alternatively, the power actuators of the present invention can be actuated in response to electronic controls.

Preferably, the lift arm and pick-up arm are constructed and located to provide a nonobstructed forward view from the cab to the collection container when in the load position.

A method for lifting, tilting and dumping refuse collection containers also forms part of the present invention. A vehicle is provided with a cab and a storage container positioned rearward of the cab. The cab and the storage container are substantially equal and coextensive width. A lift arm is pivotally mounted at a first end rearward of the cab and has a second end extending forward of the cab. The lift arm also has an intermediate section joining the first and second lift arm ends. The intermediate section is positioned in part at an elevation above the cab, and the lift arm thereby provides a nonobstructed view from the cab while facilitating entry to and exit from the cab. A pick-up arm is also provided. The pick-up arm has an end associated with a mechanism operable to engage a collection container. A front link assembly rotatably associated with the second end of the lift arm is also provided. The front link assembly connects the second end of the lift arm with the pick-up arm. The lift arm is pivoted about a vertical axis to move the engaging mechanism to a position laterally displaced from the storage container. The collection container is engaged, and the lift arm is again pivoted about the vertical axis to move the engaging mechanism and collection container to a position laterally adjacent the storage container. Now, the pick-up arm is rotated about a vertical axis to move the engaging mechanism to a position in front of the cab. The lift arm is then moved upwardly and rearwardly over the cab; simultaneously, the front link assembly is rotated with respect to the lift arm, moving the container from a lower load position near ground level to an upper off-load position at which the collection container is positioned adjacent the inlet opening. The rotational movement of the front link assembly operates to decrease the effective lift arm length during tilting and dumping of the container. The container movement between load and off-load positions defines a container path which is non-circular. Preferably, the steps of rotating the pick-up arm about a vertical axis and moving the lift arm upwardly and rearwardly over the cab occur simultaneously and in synchronistic relationship.

Other features and advantages of the invention will become apparent upon review of the drawings, description, and claims.

DESCRIPTION OF THE PREFERRED EMBODIMENTS

Figure 1:
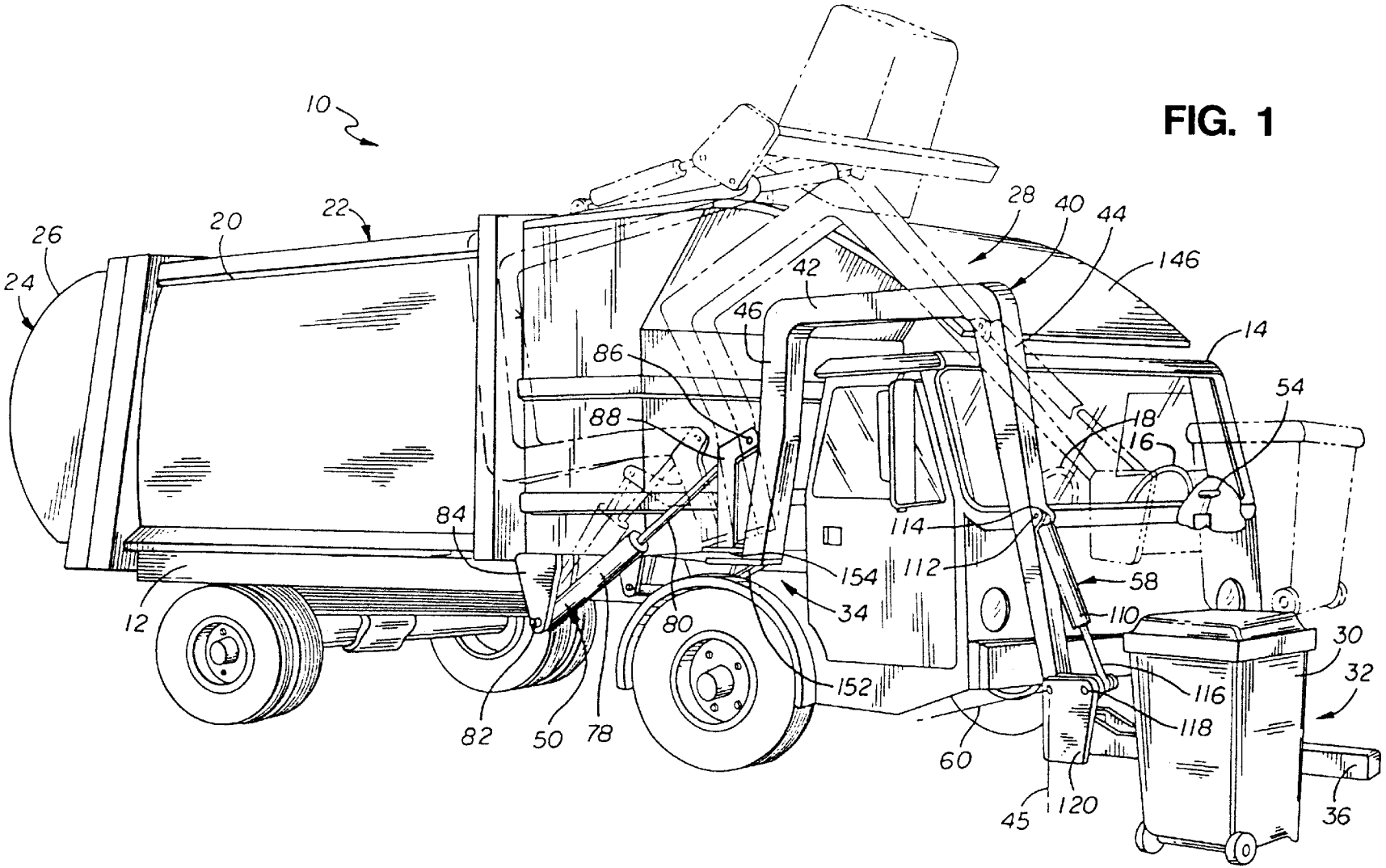
FIG. 1 is a side perspective view of a waste collection vehicle having a lifting and loading assembly that embodies the features of the invention.

A vehicle 10 for collecting and transporting waste materials is shown in FIG. 1. The vehicle 10 includes a wheeled chassis or frame 12. The driver's compartment or cab 14 is located at the front end of the chassis, as is the engine (not shown) that propels the vehicle.

As shown in FIG. 1, the vehicle 10 has a single left-hand steering wheel 16. Alternatively (as shown in phantom lines in FIG. 1), two steering wheels can be provided, the normal left-hand wheel 16 and a special right-hand wheel 18, located on the side where curbside refuse collection containers are picked up. However, as will become apparent, the invention effectively eliminates the need for a second steering wheel on the right-hand side of the cab.

A container 20 having a relatively large volume interior collection area (for example, twenty (20) cubic yards) is carried on the frame 12 behind the cab 14. Waste materials are loaded into the container 20 for transportation to a disposal or recycling site. The container 20 includes an inlet opening 22 located in the top front section. Waste materials are loaded into the collection area through this inlet opening 22.

The container may also conventionally include a rear opening 24 (see FIG. 1), with a pivotally attached tailgate 26, through which the waste materials are off-loaded from the interior area. A conventional packing/ejector panel (not shown) movable within container 20 can be used to pack the waste materials (when the tailgate 26 is closed) and to push the waste materials out of the container (when the tailgate is opened) at a transfer station, landfill, or recycling center. The ejector panel is conventionally actuated by a conventional double-acting telescopic hydraulic cylinder (also not shown).

In accordance with the invention, the vehicle includes an apparatus 28 carried on the frame 12 for lifting and loading waste materials into the inlet opening 22. In the particular embodiment shown (see FIGS. 1 to 5), the apparatus 28 engages one or more conventional curbside waste collection containers 30 from a ground-level load position (shown in FIGS. 1 and 2), located either in front or along the right-hand side of the vehicle 10. The apparatus 28 then lifts these containers 30 in front of and above the cab 14 (shown in phantom lines in FIG. 1 and in the sequence shown in FIGS. 3 to 5) to dump their contents through the inlet opening 22 into the collection container 20. The apparatus 28 then reverses and returns the emptied collection containers to their original pick-up position alongside or in front of the vehicle 10.

Figure 2:
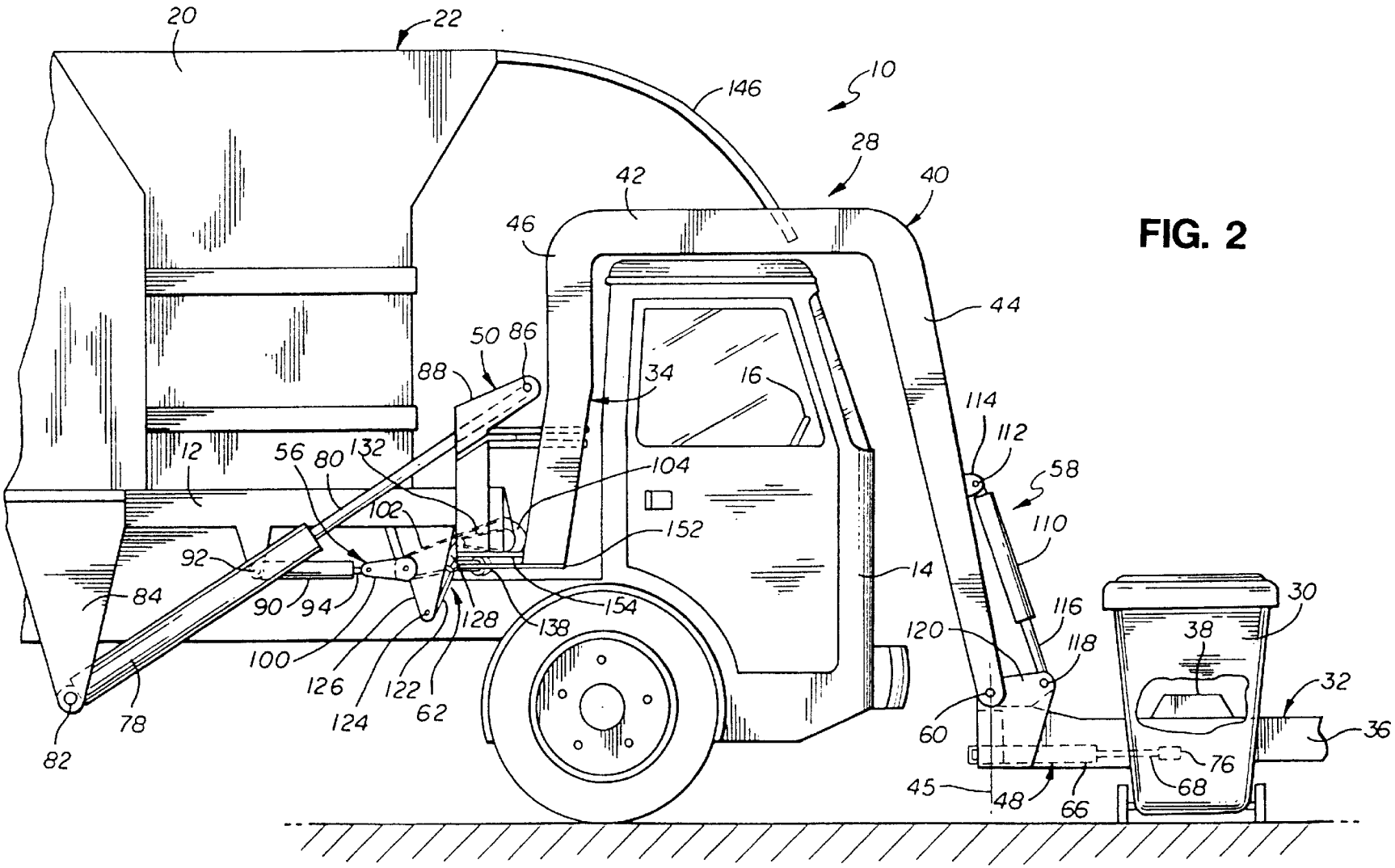
FIG. 2 is a side elevation view of the front end of the vehicle shown in FIG. 1, showing the lifting and loading assembly in a ground level load position.

In carrying out the above-described sequence of operation, apparatus 28 includes a pick-up arm 32 for engaging at its distal end one or more collection containers 30 at ground level (as shown in FIG. 2). The apparatus 28 also includes a lift assembly 34 for positioning and raising pick-up arm 32 in the manner generally shown in FIGS. 3 to 5.

Although a proximal portion of lift assembly 34 could be mounted to either the vehicle frame 12 (as is conventional) or to the storage container 30, lift assembly 34 is preferably mounted to the storage container. Since vehicle frames vary in width, depth, material, etc., the ability to mount the lift assembly to the storage container permits the vehicle to be assembled more efficiently.

Pick-up arm 32 includes an elongated bar 36 that, in length, generally matches the transverse width of the vehicle's wheel-base. Pick-up arm 32 also includes a suitable gripping mechanism or grabber 38 (shown schematically in FIG. 2). In use, gripper 38 engages the containers 30 to be lifted. Conventional gripping mechanisms vary according to the type of container used. It is preferred to use, instead, a universal engaging mechanism that can engage containers of various sizes and shapes. Particularly preferred for use with the automated refuse vehicle of the present invention is the universal engaging mechanism described in U.S. Ser. No. 07,568,599, filed on Dec. 5, 1995 and titled "Universal Engaging Mechanism For Collection Containers".

Lift assembly 34 includes a lift arm 40. As shown in FIGS. 1 to 5, the lift arm preferably takes the configuration of an inverted U, having a horizontal crossbar section 42 and a pair of front and rear downwardly depending legs, respectively 44 and. 46. In its lowermost position above the ground (see FIGS. 1 and 2), the crossbar section 42 extends just above the top of the cab 14, so as not to interfere with the driver's front or side views. The end portion of the rear lift arm leg 46 is attached to a plate 152, which in turn is pivotably attached, via pivot axle 148 (FIGS. 6–7), to a plate 154. The plate 154 is further attached to a tilt axle 104 carried by the frame 12 near the front end of the container 20, behind the cab 14 (see FIGS. 6 to 8). The front lift arm leg 44 extends just in front of the side of the cab 14, again so as not to interfere with the driver's front and side views. The end portion of the front lift leg 44 is attached to pick-up arm 32. When in its lowermost position above the ground (again, see FIGS. 1 and 2), the front lift arm leg 44 holds pick-up arm 32 at a desired minimum height above ground level. In the illustrated embodiment, this is generally at the axle height of vehicle 10.

The use of the inverted U-shaped pick-up arm 32 permits the lift assembly to be mounted rearward of the cab. This positioning of the lift assembly permits the use of a standard, conventional (unmodified) cab. Thus, the driver can operate the apparatus 28 from within the cab 14 from either a left-hand or a right-hand steering location.

Ancillary advantages also arise from the use of an unmodified cab instead of the half-cab described, for example, in U.S. Pat. No. 4,175,903 to Carson and U.S. Pat. No. 3,765,554 to Morrison. These advantages include easy entry to and exit from either side of the cab, and an unobstructed view of the collection container during loading and unloading. Additionally, this arrangement enhances the safety of the vehicle, since an operator seated in the left-hand cab side can work the controls with his right hand (providing typically right-handed operators with increased control).

Mounting the lift assembly rearward of the cab also substantially enhances the maneuverability of the vehicle. Mounting a lift assembly adjacent a half-cab (as described in Carson and Morrison) results in the lift assembly being positioned forward of the cab a greater distance than with the present invention. The effective length of the lift arm, however, must still be long enough to clear the container height and the cab height. Morrison and Carson, for example, must therefore employ longer lift arms which (absent the use of a telescoping lift arm) will project farther forward of the cab than the lift assembly of the present invention. For this reason, the present invention results in a design which is safer, and a vehicle which is more maneuverable (particularly in tight curves, such as culdesacs), than known prior art.

Figure 10:
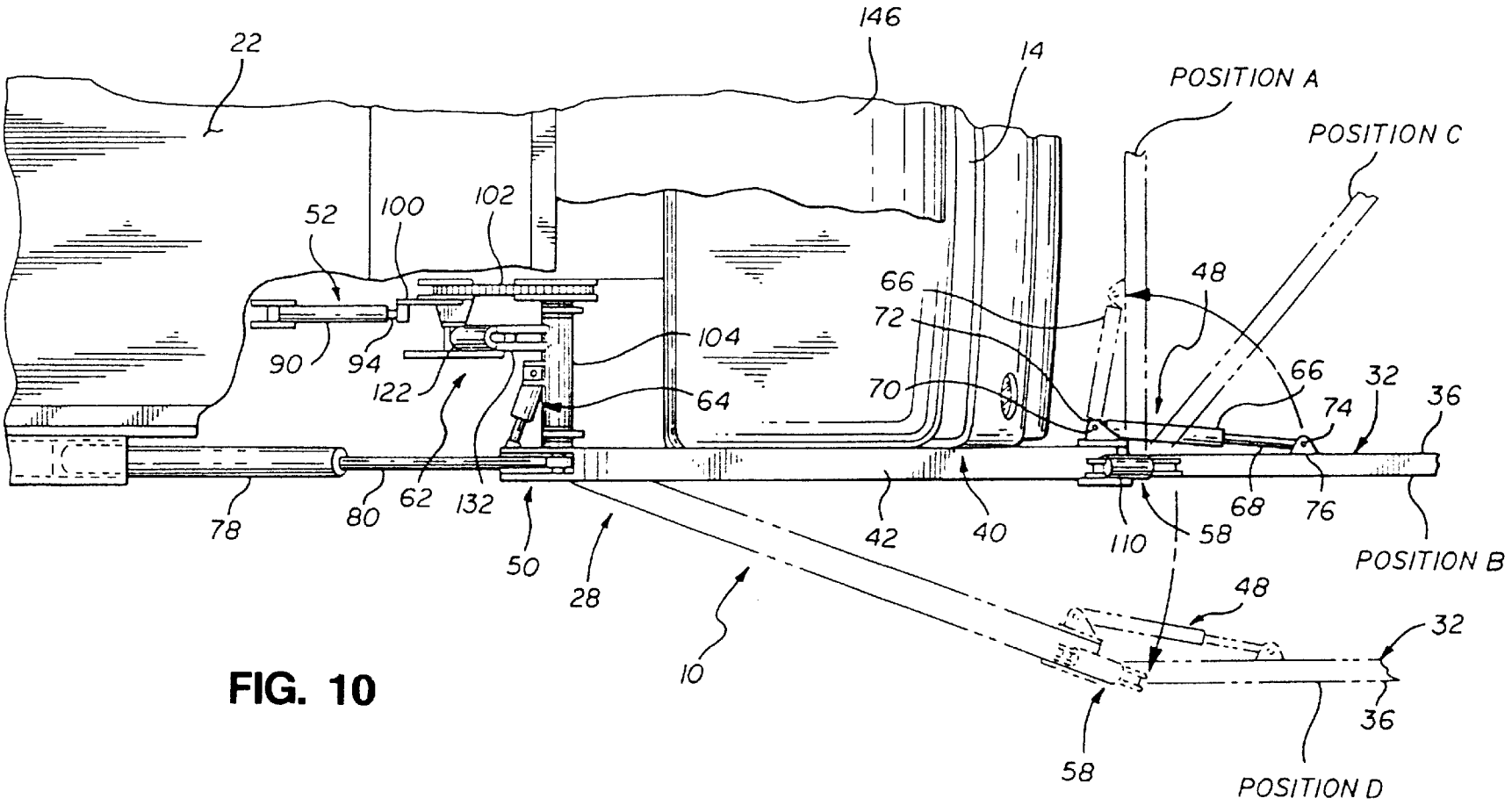
FIG. 10 is a top view of the front end of the vehicle shown in FIG. 9, with portions broken away, showing the lateral side movement of the lifting and loading assembly from a different perspective.

As best shown in FIG. 10, apparatus 28 further includes a first actuating mechanism 48 for laterally swinging pick-up arm 32 relative to the front lift arm leg 44 about an axis 45 that is generally perpendicular to the ground (see also FIG. 2). This lateral swinging motion serves to move the pick-up arm between a close-in position along the front of the vehicle 10 (shown in phantom line Position A in FIG. 10) and an outreaching position spaced away from and off to the right-hand side of the vehicle 10 (shown in solid line Position B in FIG. 10). The apparatus 28 is thereby capable of picking up containers 30 either in the front of the vehicle 10 (when in Position A) or off to the right-hand side of the vehicle 10 (when in Position B), using the particular gripping mechanism 38 associated with pick-up arm 32.

Figure 3:
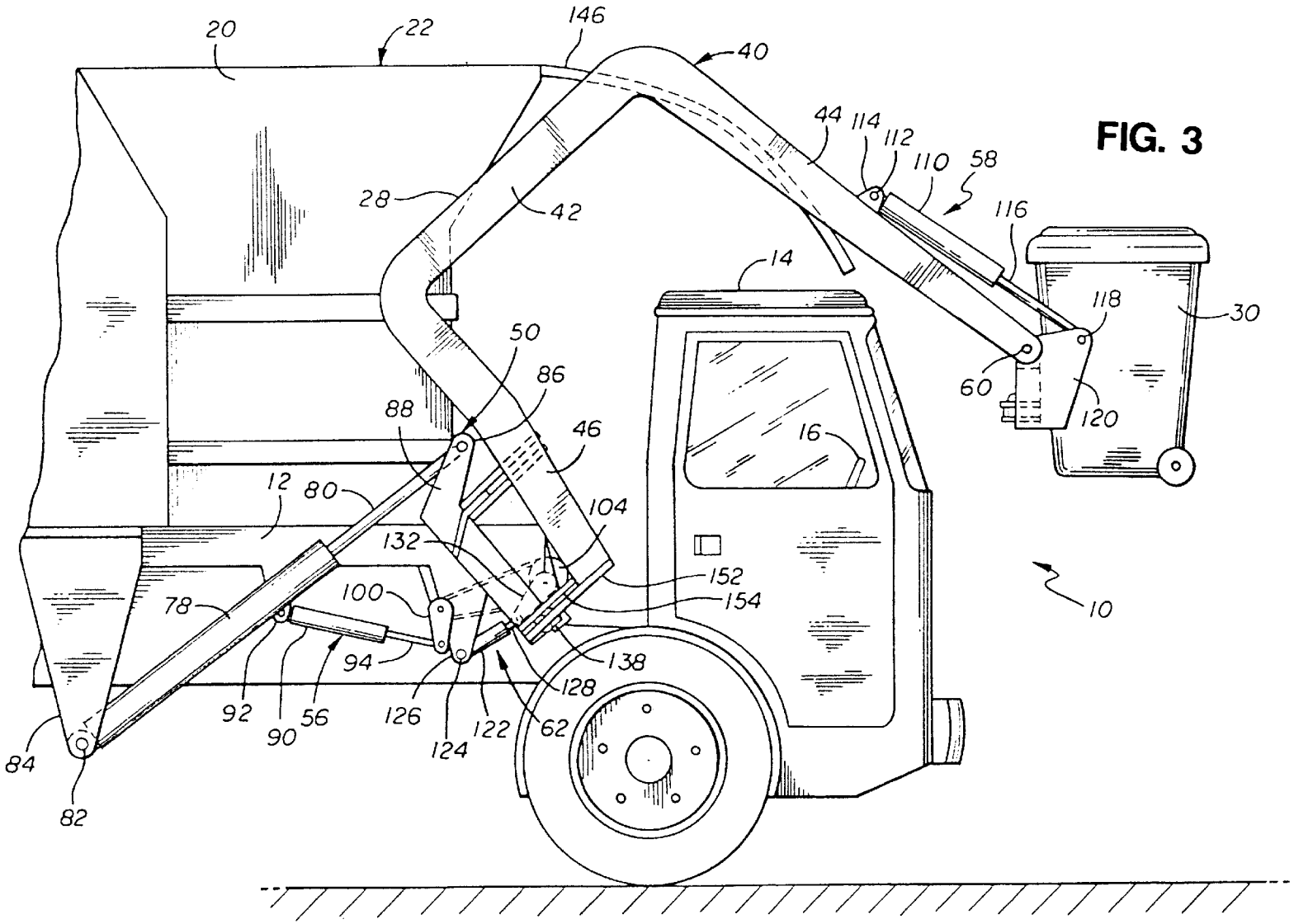
FIGS. 3–5 are side elevation views similar to FIG. 2, showing the sequential operation of the lifting and loading assembly in raising a collection container into an upraised off-load position.
Figure 4:
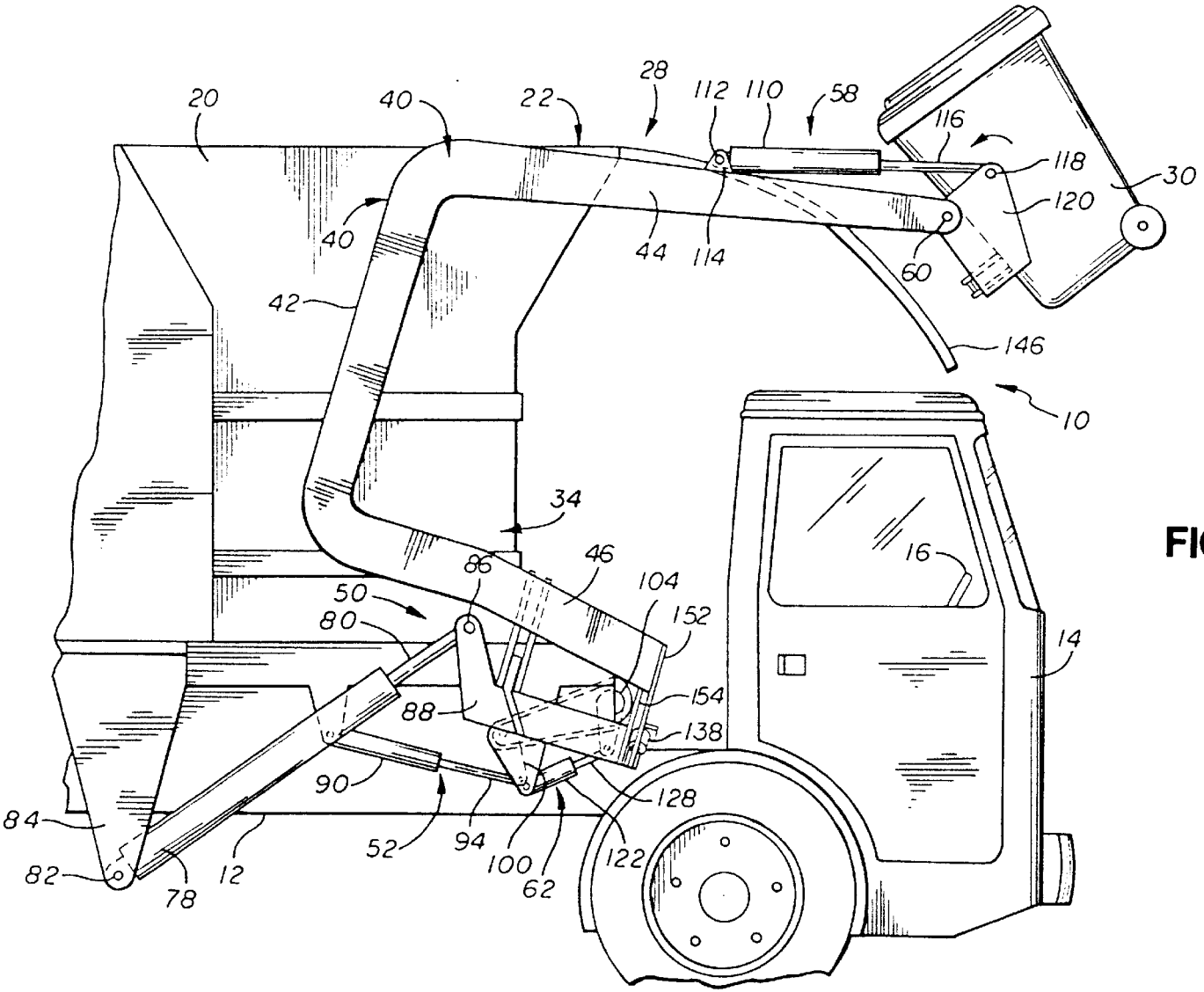
Figure 5:
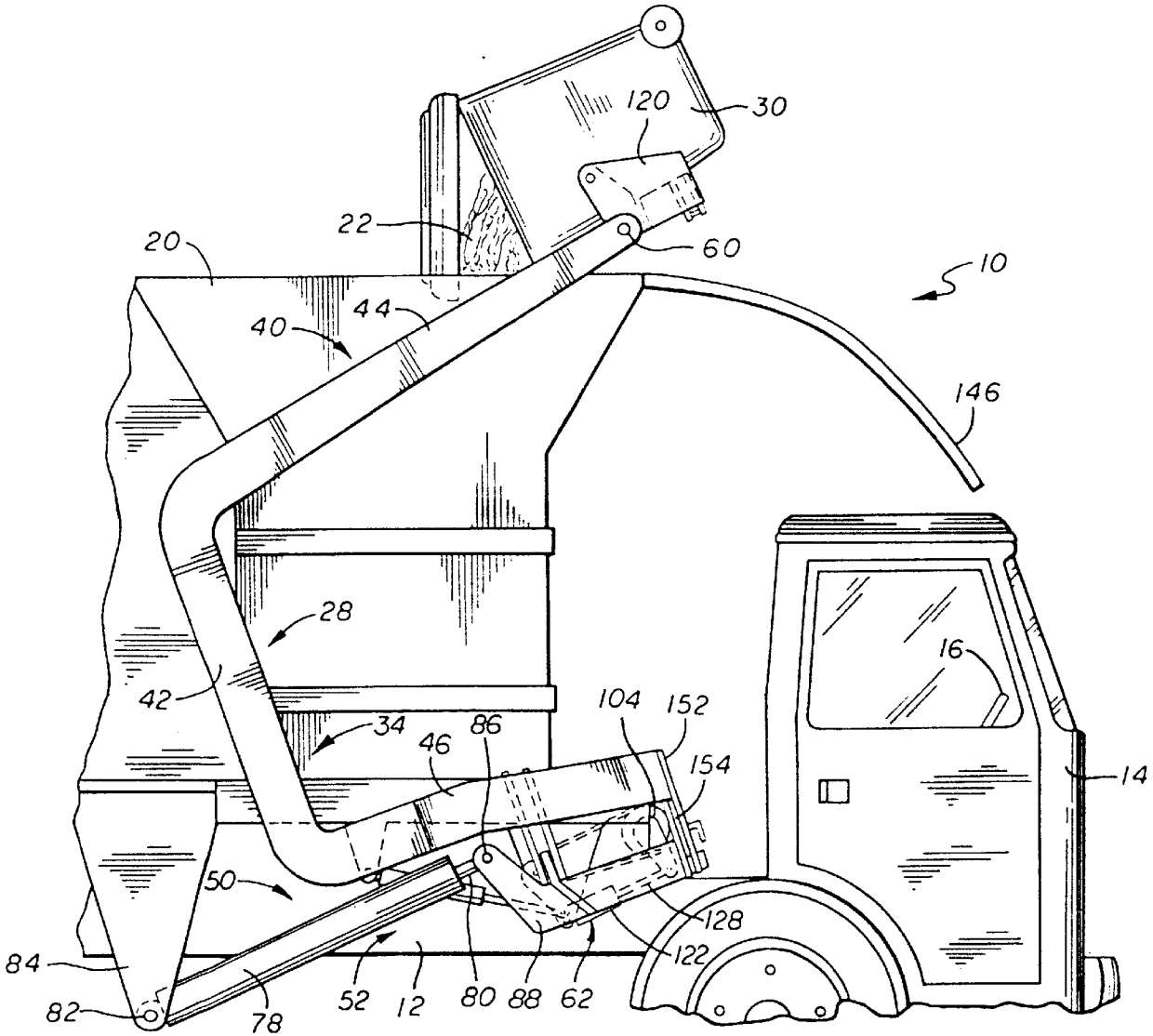

As shown in FIGS. 2–5, the apparatus 28 further includes a second actuating mechanism 50 for moving lift arm 40 about tilt axle 104 between a load level, shown in FIGS. 1 and 2, at which pick-up arm 32 is located at the selected height near ground level, and an off-load level, shown in FIG. 5, at which pick-up arm 32 is raised to the level of the inlet opening 22. Intermediate FIGS. 3 and 4 show the sequence of movement between the load level and the off-load level.

For the situation where the collection container 30 is to be picked up along the right-hand side of the vehicle, the apparatus provides a first controlling mechanism 52 (FIGS. 4–5) that interconnects the first and second actuating mechanisms 48 and 50 to coordinate the lateral swinging movement of pick-up arm 32 with the up-and-down movement of lift arm 40.

More particularly, first controlling mechanism 52 automatically moves pick-up arm 32 into its outreaching position (Position B in FIG. 10) as lift arm 40 moves toward the load level. First controlling mechanism 52 also automatically moves pick-up arm 32 sequentially into the close-in position (Position A in FIG. 10) as lift arm 40 moves toward the off-load level. As shown in FIGS. 2 and 3, pick-up arm 32 is moved from its outreaching position into the close-in position preferably by the time pick-up arm 32 has reached the top of the cab 14.

First controlling mechanism 52 is preferably actuated by the operator using a single control level 54 (see FIG. 1) situated in cab 14. The driver can thus both raise and lower lift arm 40 and position pick-up arm 32 in either loading or off-loading operations with the single control lever 54.

In the illustrated and preferred embodiment, the first actuating mechanism 48 includes means (see FIGS. 11*a*, 11*b* and 11*c*) for automatically controlling the speed at which the pick-up arm moves between its close-in and outreaching positions. More particularly, the speed control means 56 increases the velocity of pick-up arm 32 as it moves from the outreaching position toward the close-in position, until a desired intermediate position is reached (shown in phantom line Position C in FIG. 10). The speed control means 56 then automatically decreases the velocity of pick-up arm 32 as it moves from the intermediate position toward the close-in position. Likewise, the speed control means 56 is further operative for automatically increasing the velocity of pick-up arm 32 as it moves from the close-in position toward the intermediate position, and then decreasing the velocity as pick-up arm 32 moves from the intermediate position toward the outreaching position. Optimal control of the pick-up arm movement when it is either close to the ground or close to the cab is thereby achieved. Reduced wear on parts caused by sudden starts and stops of the lift assembly is also thereby provided.

In the illustrated and preferred embodiment, and as will be described in greater detail below, first controlling mechanism 52 can be selectively disabled by the operator to maintain pick-up arm 32 in its close-in position during movement of lift arm 40 between its load and off-load levels. The apparatus 28 is thereby readily adaptable to the situation where the collection container 30 is to be engaged in front of the cab.

The apparatus 28 further includes a third actuating mechanism 58 (FIGS. 1–4, 9–10) that pivots pick-up arm 32 relative to the front lift arm leg 33 about an axis 60 that is generally parallel to the ground (see FIGS. 1 and 10). This pivotal movement serves to move pick-up arm 32 between a load position (see FIGS. 2 and 3) holding the engaged container 30 generally vertical relative to the ground and an off-load position (see FIGS. 4 and 5) holding the engaged containers 30 in a tipped relationship relative to the ground. As shown in FIG. 5, when lift arm 40 is situated in its off-load level with pick-up arm 32 in its close-in and off-load position, the contents of the engaged containers are dumped by gravity into container 20 through opening 22.

Apparatus 28 includes a second controlling means 62 (FIGS. 6–10) interconnecting the second and third actuating mechanisms 50 and 58, to thereby coordinate pivotal movement of pick-up arm 32 about axis 60 with the up-and-down movement of lift arm 40. More particularly, as shown in FIGS. 2 and 3, the second controlling mechanism 62 automatically maintains pick-up arm 32 in its load position as lift arm 40 moves between its load level and a predetermined level above the ground. In the illustrated embodiment, the predetermined level is just above the front window of the cab 14 (see FIG. 3).

Second controlling mechanism 62 thus serves to hold the engaged container 30 generally vertical to the ground until the of the cab 14 is cleared. Spillage of waste materials in front of the cab 14 is thereby avoided as lift arm 40 is raised.

Second controlling mechanism 62 also preferably serves to coordinate movement of pick-up arm 32 into its off-load position. Thus, as shown in FIGS. 4 and 5, as the engaged containers 30 are brought close to inlet opening 22, they are successively tipped to dump their contents into container 20. A dump shield 146 is provided to protect the top of cab 14 from materials accidentally spilled from container 30.

In the illustrated preferred embodiment, second controlling mechanism 62 is actuated by the same single control lever 54 as the first controlling mechanism 52. Thus, all the desired relative movement of lift arm 40 and pick-up arm 32 is coordinated using the single control 54.

Figure 9:
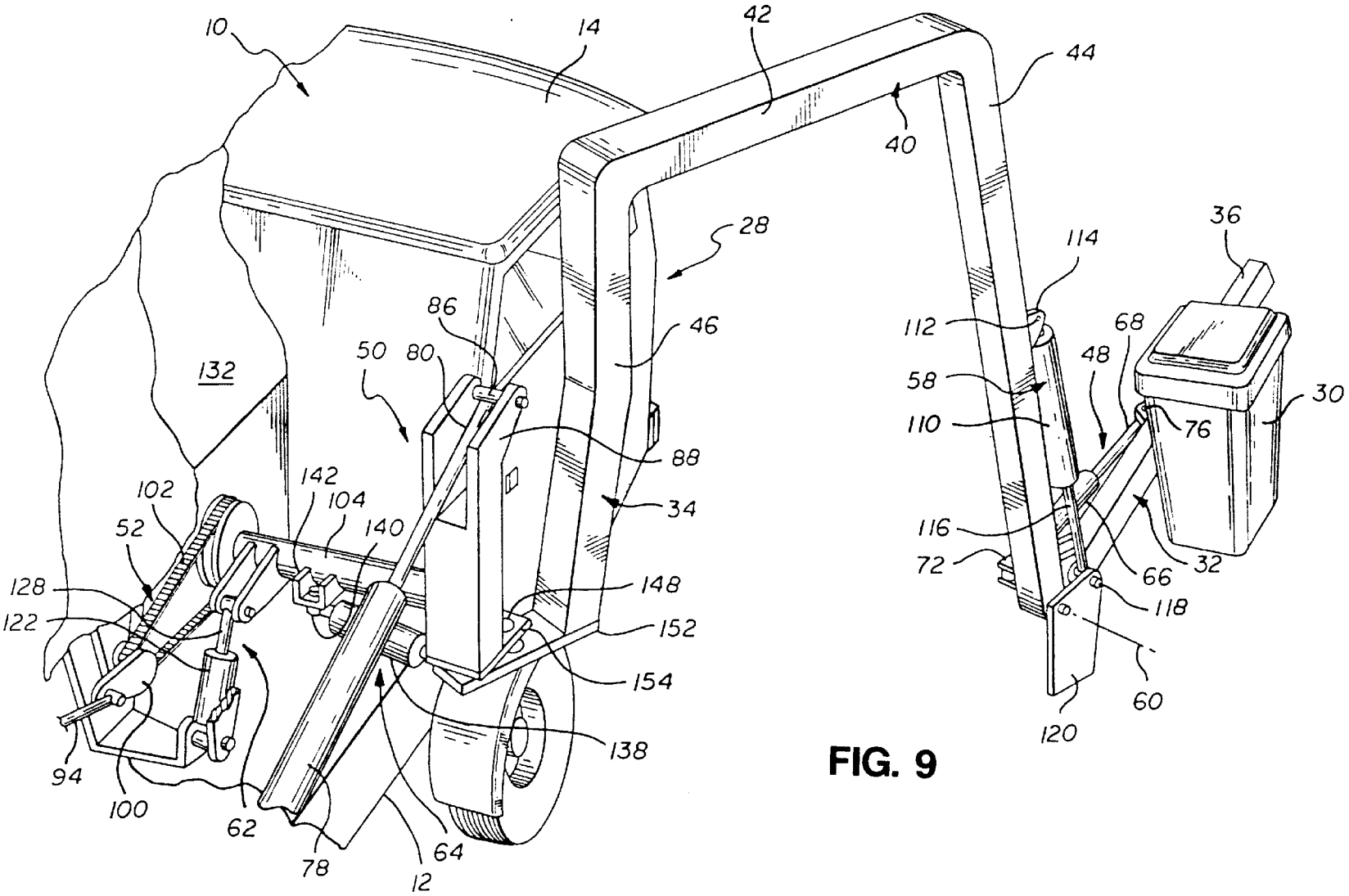
FIG. 9 is a perspective view of the vehicle shown in FIG. 1, looking forward from a raised vantage point, showing the lateral side movement of the lifting and loading assembly.

As shown in FIGS. 9 and 10, for the situation where the collection containers 30 are spaced off the right-hand side of cab 14, the apparatus 28 includes a fourth actuating mechanism 64 for moving lift arm 40 about a pivot axle 148 between a normal first position next to cab 14 (shown in solid line Position B in FIG. 10), and a second position angularly spaced off to the side of cab 14 (shown in FIG. 9 and as phantom Position D in FIG. 10).

Preferably, the fourth actuating mechanism 64 is also controlled by the same, heretofore described control lever 54. Thus, by moving the control lever 54 fore and aft, lift arm 40 can be raised and lowered, together with the automatically coordinated movement of pick-up arm 32. By moving the control level 54 to the side, lift arm 40 can be moved sideways between its first and second positions shown in FIGS. 9 and 10.

As shown, first actuating mechanism 48 takes the form of a hydraulic cylinder 66 that controls a piston rod 68. As shown in FIG. 10, cylinder 66 is pivotally attached by a pin 70 to a bracket 72 on the front lift arm leg 44. The piston rod 68 is likewise pivotally attached by a pin 74 to a bracket 76 on pick-up arm 32. Extension of piston rod 68 in response to hydraulic fluid introduced into the base end of cylinder 66 moves pick-up arm 32 toward its outreaching position (Position B in FIG. 10). Likewise, retraction of piston rod 68 in response to hydraulic fluid introduced into the piston end of cylinder 66 moves pick-up arm 32 to the close-in position (Position A in FIG. 10).

Also in this arrangement, as shown in FIGS. 1 and 10, the second actuating mechanism 50 takes the form of another conventional hydraulic cylinder 78 controlling a piston rod 80. Cylinder 78 is pivotally attached by a pin 82 to a bracket 84 extending below frame 12. Piston rod 86 is likewise pivotally attached by a pin 86 to a bracket.88 extending from plate 154. As shown in FIGS. 3 to 5, retraction of piston rod 80 by the introduction of hydraulic fluid into the piston rod end of cylinder 78 serves to tilt rear lift leg 46 about axle 104, to thereby raise lift arm 40 toward its off-load level. Conversely, extension of the piston rod by the introduction of hydraulic fluid into the base end of the cylinder serves to tilt lift arm 40 toward its load level.

Figure 6:
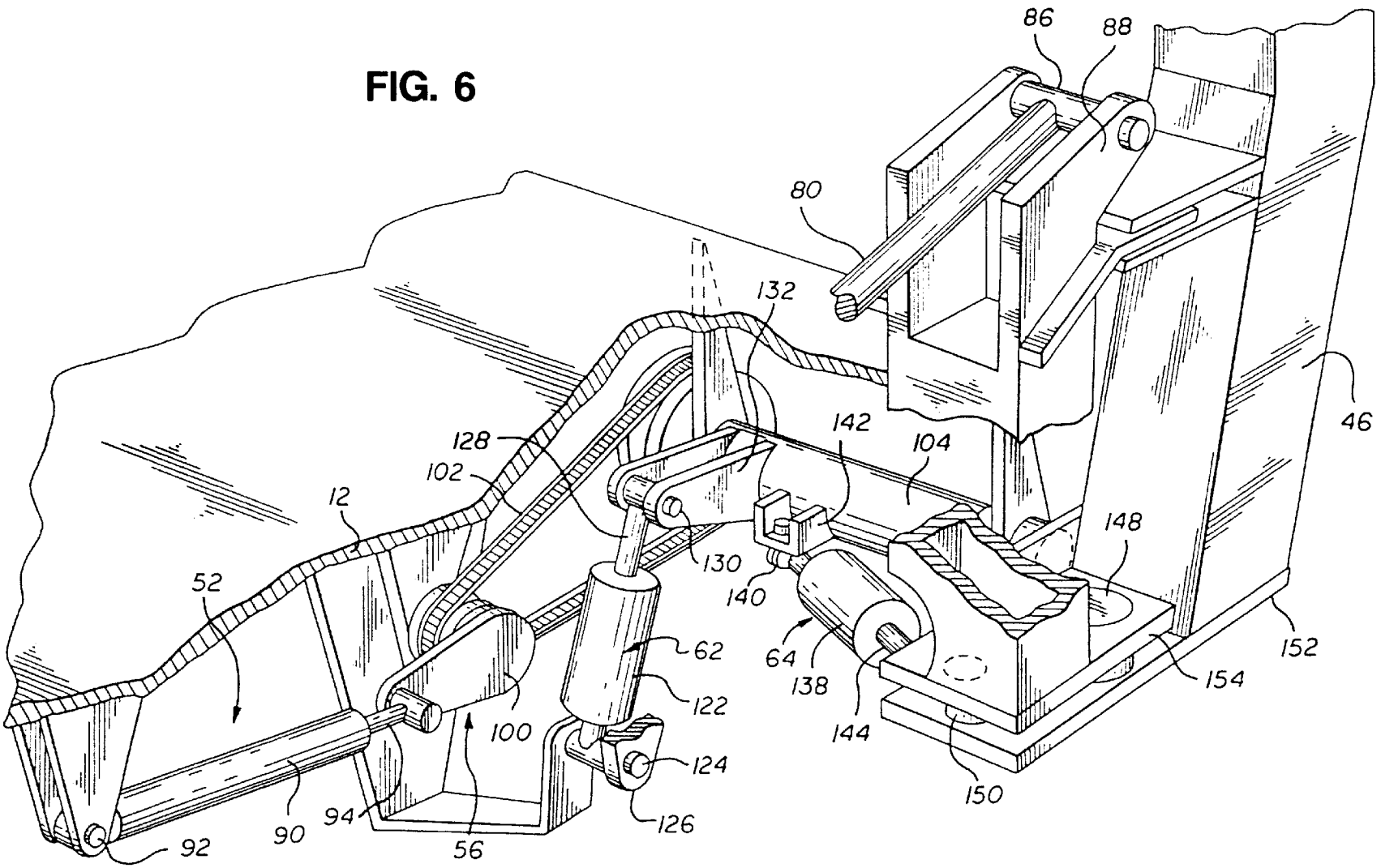
FIGS. 6 to 8 are enlarged perspective views of a portion of the control mechanism that can be used in the lifting and loading assembly shown in FIG. 1, with portions broken away, showing the sequential operation and interrelationship of various control elements that embody the features of the invention.
Figure 7:
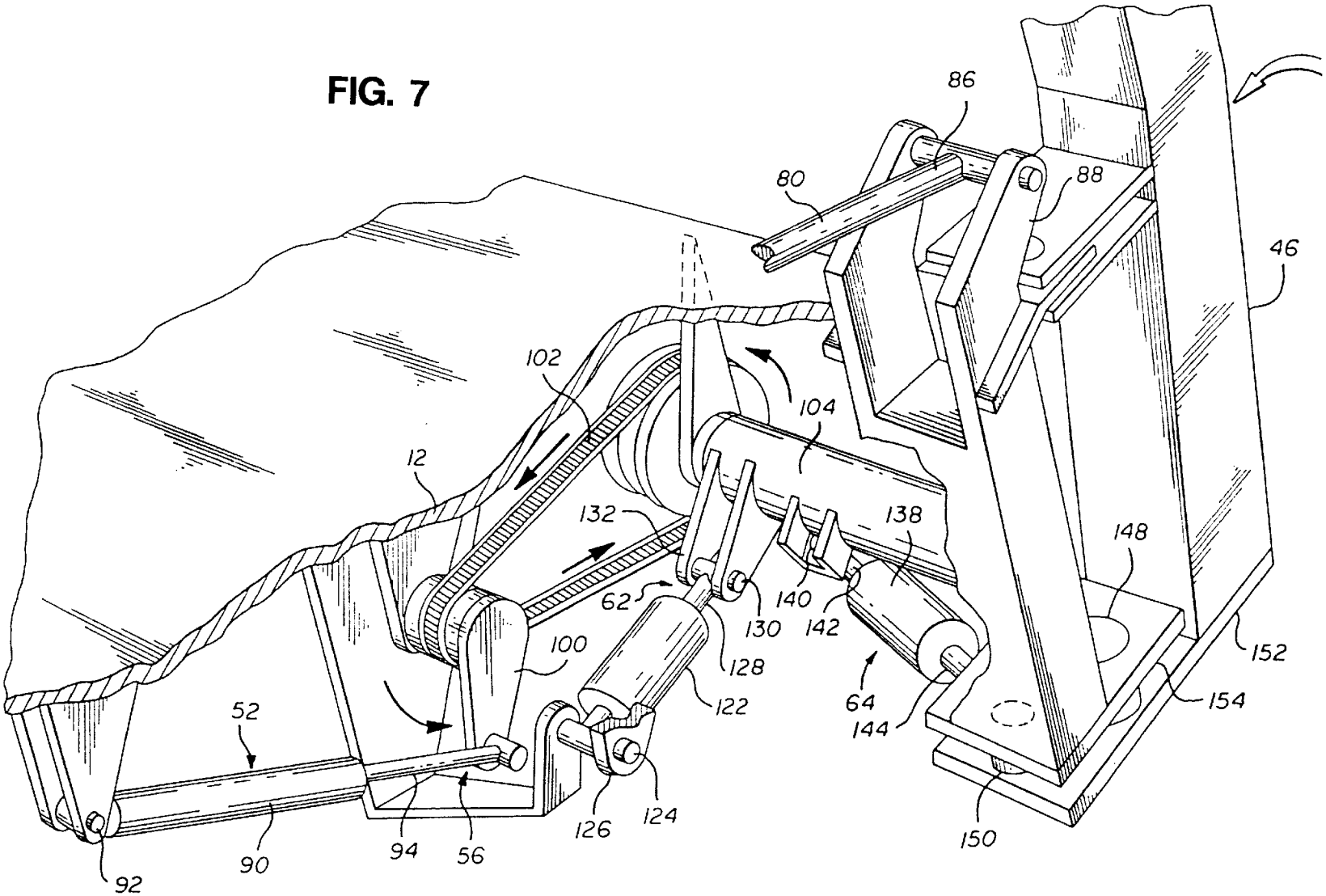
Figure 8:
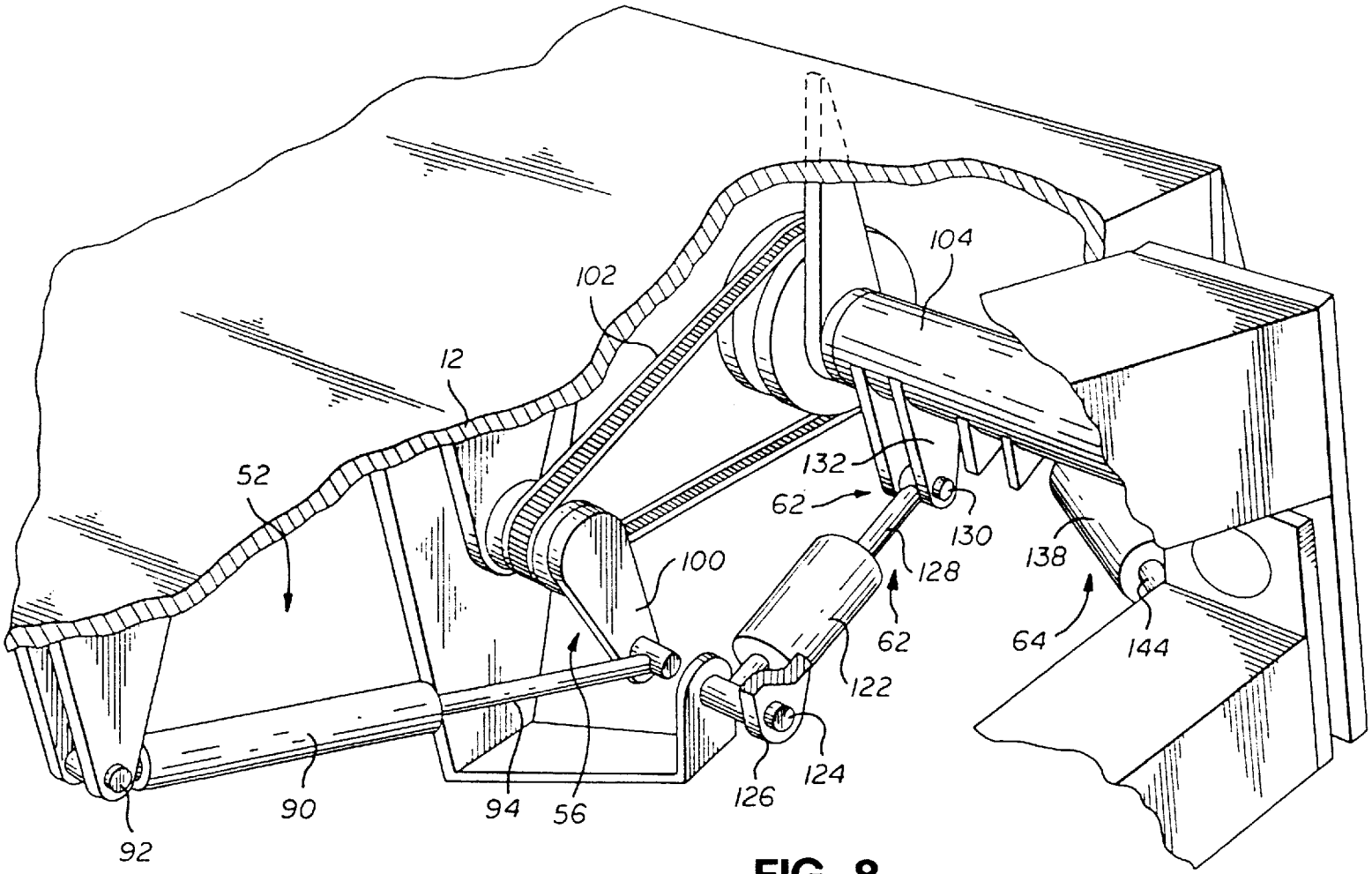
Figure 11A:
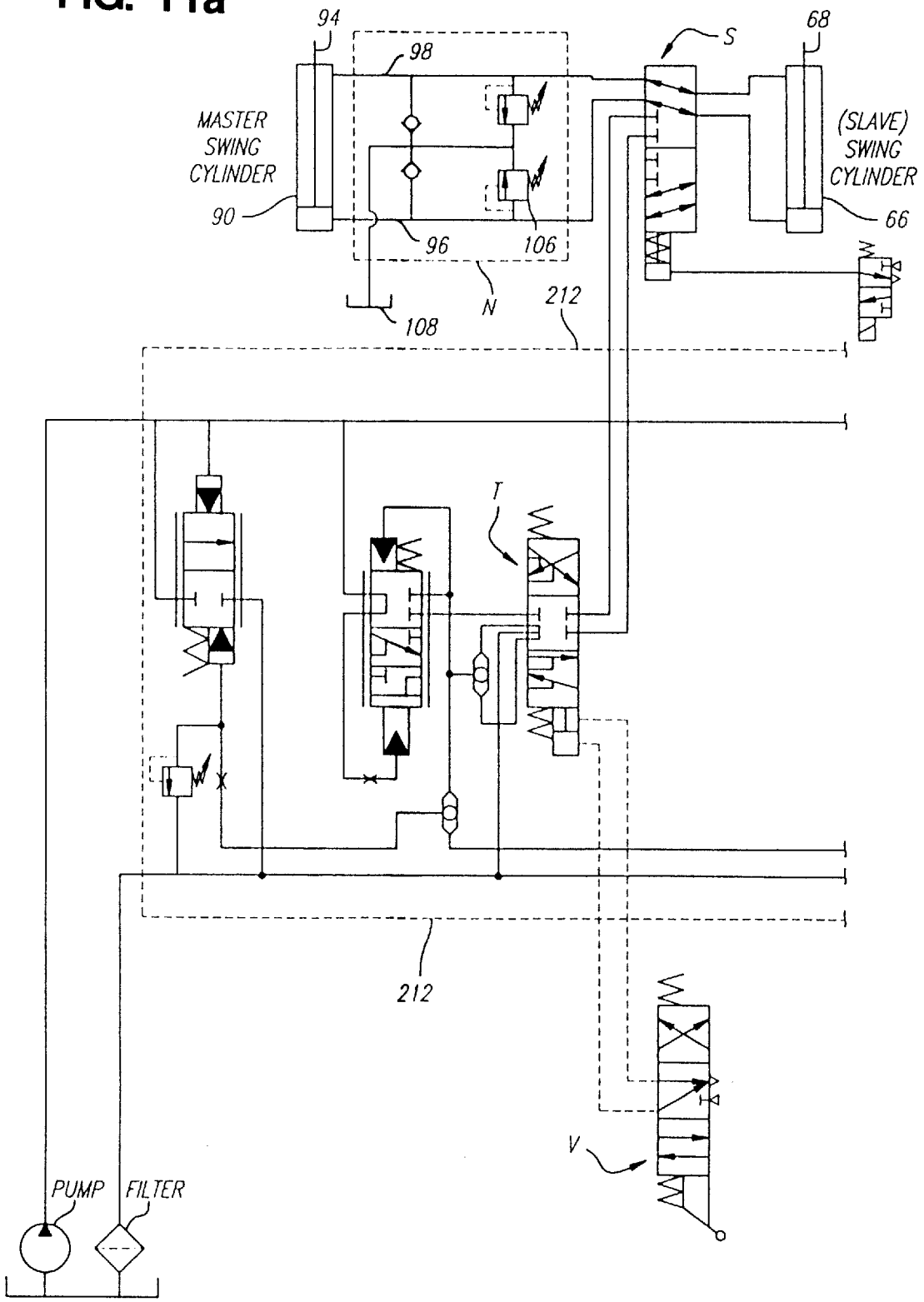
FIGS. 11(*a*), 11(*b*) and 11(*c*) are schematic views of a fluid pressure control circuit for the lifting and loading assembly shown in FIGS. 1–10.

In this arrangement, first controlling mechanism 52 takes the form of a conventional hydraulic cylinder 90 (FIGS. 2–4, 10) pivotally attached by a pin 92 to frame 12. Cylinder 90 has a piston rod 94. Cylinder 90 is connected with cylinder 66 in a master-slave relationship, in which cylinder 90 is the master and cylinder 66 is the slave. More particularly, as shown in FIG. 11*a*, a conduit 96 (see FIG. 11*a*) connects the base end master cylinder 90 with the base end of slave cylinder 66. Another conduit 98 (see FIG. 11*a*) connects the piston rod end of master cylinder 90 with the piston rod end of slave cylinder 66. As best shown in FIGS. 6–8, master piston rod 94 is moved into and out of master cylinder 90 by a bell crank 100 that is operatively connected by a chain drive 102 to tilt axle 104. As described above, up-and-down movement of lift arm 40 in response to cylinder 78 rotates tilt axle 104. As lift arm 40 is moved toward its off-load position (by retraction of piston rod 80), tilt axle 104 and chain drive 102 rotate counterclockwise (see FIG. 7). This in turn rotates bell crank 100 counterclockwise.

As shown in FIGS. 6–8, rotating bell crank 100 pulls master piston rod 94 successively out of master cylinder 90. Hydraulic fluid is displaced from the piston rod end of master cylinder 90 via the conduit 98 into the piston rod end of the slave cylinder 66. The slave piston rod 68 is thereby moved into the slave cylinder 66.

As shown in FIG. 10, pick-up arm 32 is thereby automatically moved from its outreaching position toward its close-in position as lift arm 40 is moved upwardly from its load level. Slave piston rod 68 reaches its fully retracted position (shown in phantom position B in FIG. 10), maintaining pick-up arm 32 in its close-in position, as lift arm 40 reaches the predetermined above-cab-height level (shown in FIG. 3).

Subsequent downward movement of lift arm 40 from the above-cab-height level (shown in FIG. 3) back toward the load level (by the extension of the piston rod 80) serves to rotate tilt axle 104 and chain drive 102 in the opposite direction, or clockwise. Bell crank 100 is thereby rotated clockwise, pushing master piston rod 94 into master cylinder 90. Hydraulic fluid is displaced from the base end of master cylinder 90 via the conduit 96 into the base end of slave cylinder 66. Slave piston rod 68 is thereby moved out of slave cylinder 66, moving pick-up arm 32 back toward its outreaching position. Slave piston rod 68 reaches its fully extended position, maintaining the pick-up arm in its outreaching position (position B in FIG. 10), as lift arm 40 reaches the load position. Movement of pick-up arm 32 into its outreaching position is thereby automatically coordinated with the lowering of lift arm 40 to its load level.

The speed control means 56 previously described is achieved in this arrangement by virtue of the mechanical advantage between bell crank 100 and master piston rod 94, which varies with the rotational position of bell crank 100. The velocity at which pick-up arm 32 is moved also thereby varies. More particularly, as bell crank 100 successively moves counterclockwise from the position shown in FIG. 6, pulling piston rod 94 out of cylinder 90, the mechanical advantage successively increases until bell crank 100 reaches the rotational position shown in FIG. 7. This imparts increasing velocity to the movement of pick-up arm 32 as it moves from its outreaching position (Position A in FIG. 10) to an intermediate position (Position C in FIG. 10). The mechanical advantage successively decreases as the bell crank 100 moves out of the FIG. 7 position toward the position shown in FIG. 8. This imparts decreasing velocity to the movement of pick-up arm 32 as it moves from the intermediate position (Position C in FIG. 10) to its close-in position (Position A in FIG. 10).

As shown in FIG. 11*a*, a two-way control valve 106 located in conduit 96 selectively directs hydraulic fluid either to the base end of slave cylinder 66 to automatically move pick-up arm 32 to its outreaching position, or to the sump 108. When fluid is directed to sump 108, the interconnection between the first and second activating mechanisms 48 and 50 is disabled. Pick-up arm 32 is maintained in its close-in position as lift arm 40 is raised and lowered.

Third actuating mechanism 58 takes the form of another conventional hydraulic cylinder 110 attached by a pin 112 to a bracket 114 on the front lift arm leg 44 (see FIG. 2). Cylinder 110 includes a piston rod 116 attached by a pin 118 to a bracket 120 on pick-up arm 32. As shown in FIGS. 3 to 5, extension of piston rod 80 by the introduction of hydraulic fluid into the base end of cylinder 78 rotates bracket 120 clockwise, and vice versa. In this arrangement, second controlling mechanism 62 takes the form of a cylinder 122 attached by a pin 124 to a bracket 126 extending below frame 12. Cylinder 122 includes a piston rod 128 that is attached by a pin 130 to a bell crank 132 attached to tilt axle 104. As can be seen in FIGS. 6 to 8, rotation of tilt axle 104 rotates bell crank 132 to impart movement to piston rod 128.

Figure 12:
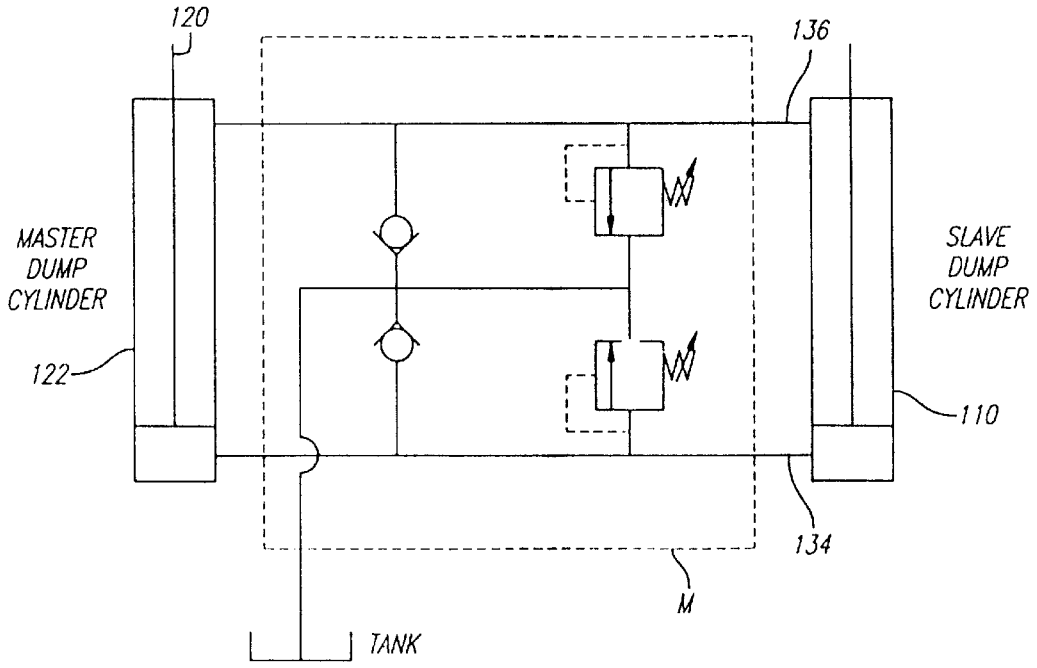
FIG. 12 shows an additional fluid pressure control circuit for providing a closed loop between a master dump cylinder and a slave dump cylinder.

Cylinder 122 is connected with cylinder 110 in a master-slave relationship, in which cylinder 122 is the master cylinder and cylinder 110 is the slave cylinder. As shown in FIG. 12, a conduit 134 connects the base ends of cylinders 110 and 122, and a conduit 136 connects the piston rod ends of cylinders 110 and 122.

As shown in FIGS. 6 and 7, as lift arm 40 is moved upwardly from its load level (by cylinder 78), the counterclockwise movement of tilt axle 104 and bell crank 132 at first pushes the master piston rod 128 into cylinder 122. Hydraulic fluid is displaced via conduit 134 from the base end of master cylinder 122 to the base end of slave cylinder 110. Slave piston rod 116 extends, pivoting pick-up arm 32 clock wise about horizontal axis 60.

The clockwise pivoting of pick-up arm 32 as lift arm 40 is raised serves to automatically maintain the engaged containers in the desired vertical relationship with the ground, until pick-up arm 32 reaches the desired height above the cab (see FIG. 3).

As shown in FIGS. 7 and 8, as lift arm 40 is subsequently raised higher toward the off-load position, continued counterclockwise rotation of bell crank 132 begins to pull master piston rod 128 out of the master cylinder 122. Hydraulic fluid is displaced via conduit 136 from the piston rod end of master cylinder 122 to the piston rod end of slave cylinder 110. Slave piston rod 116 retracts, pivoting pick-up arm 32 counterclockwise about horizontal axis 60.

The counterclockwise pivoting of pick-up arm 32 as lift arm 40 moves from the above-cab level (FIG. 3) toward the off-load position (FIGS. 4 and 5) serves to automatically tip engaged containers 30 into the desired relationship with inlet opening 22 to facilitate dumping when the off-load level is reached.

Conversely, as lift arm 40 is lowered from the off-load level (by extending piston rod 80), the now clockwise rotation imparted to bell crank 132 first pushes master piston rod 128 into master cylinder 124. Hydraulic fluid displaced from the base end of master cylinder 124 is conveyed via conduit 134 into the base end of the slave cylinder 110. Slave piston rod 116 is extended outwardly. Pick-up arm 32 is pivoted clockwise, and engaged containers 30 are thereby moved from their tipped condition back toward the desired vertical relationship with the ground. This vertical relationship is reached as lift arm 40 reaches the above-cab-level height shown in FIG. 3.

With the subsequent lowering of lift arm 40 toward the load level (FIG. 2), bell crank 132 pulls master piston rod 128 out of master cylinder 122. Hydraulic fluid conveyed via conduit 136 from the piston rod end of master cylinder 122 into the piston rod end of slave cylinder 110 retracts slave piston rod 116. Pick-up arm 32 is pivoted counterclockwise to maintain the engaged containers 30 in the desired vertical relationship.

In the illustrated arrangement, as shown in FIGS. 7–10, fourth actuating mechanism 64 takes the form of another conventional hydraulic cylinder 138 pivotally attached by a pin 140 to a bracket 142 carried by tilt axle 104. Cylinder 138 controls a piston rod 144 which is attached by a pin 150 to plate 142. Retraction of piston rod 144 serves to pivot lift arm 40 into its second position (see FIG. 9), and vice versa.

FRONT-SIDE LIFT CIRCUIT EXPLANATION

The normal operation of the lift is explained first. Second, any alternative or anomalous operations that may occur are addressed and the corresponding safety measures detailed. Third, any unique features are identified.

Figure 11B:
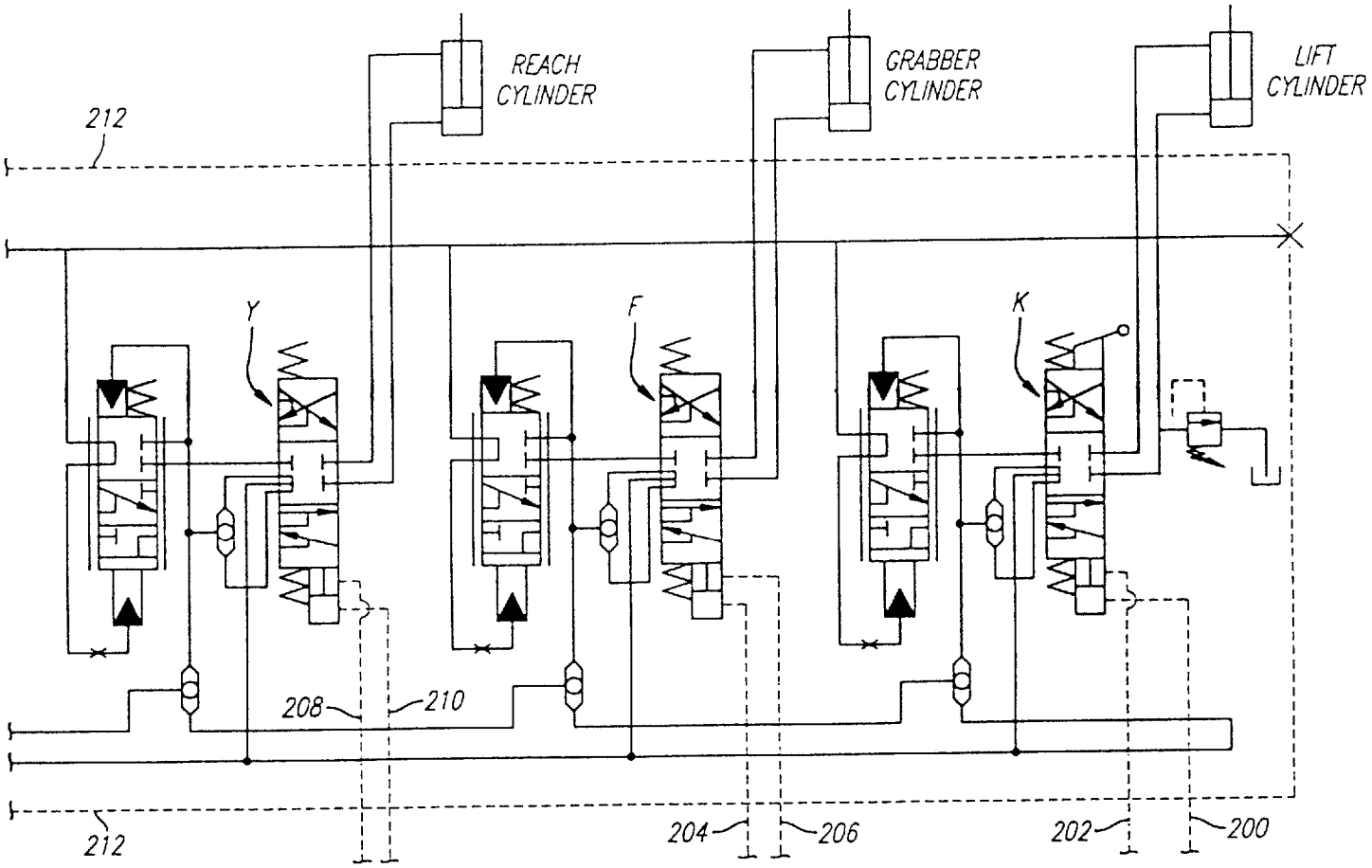
Figure 11C:
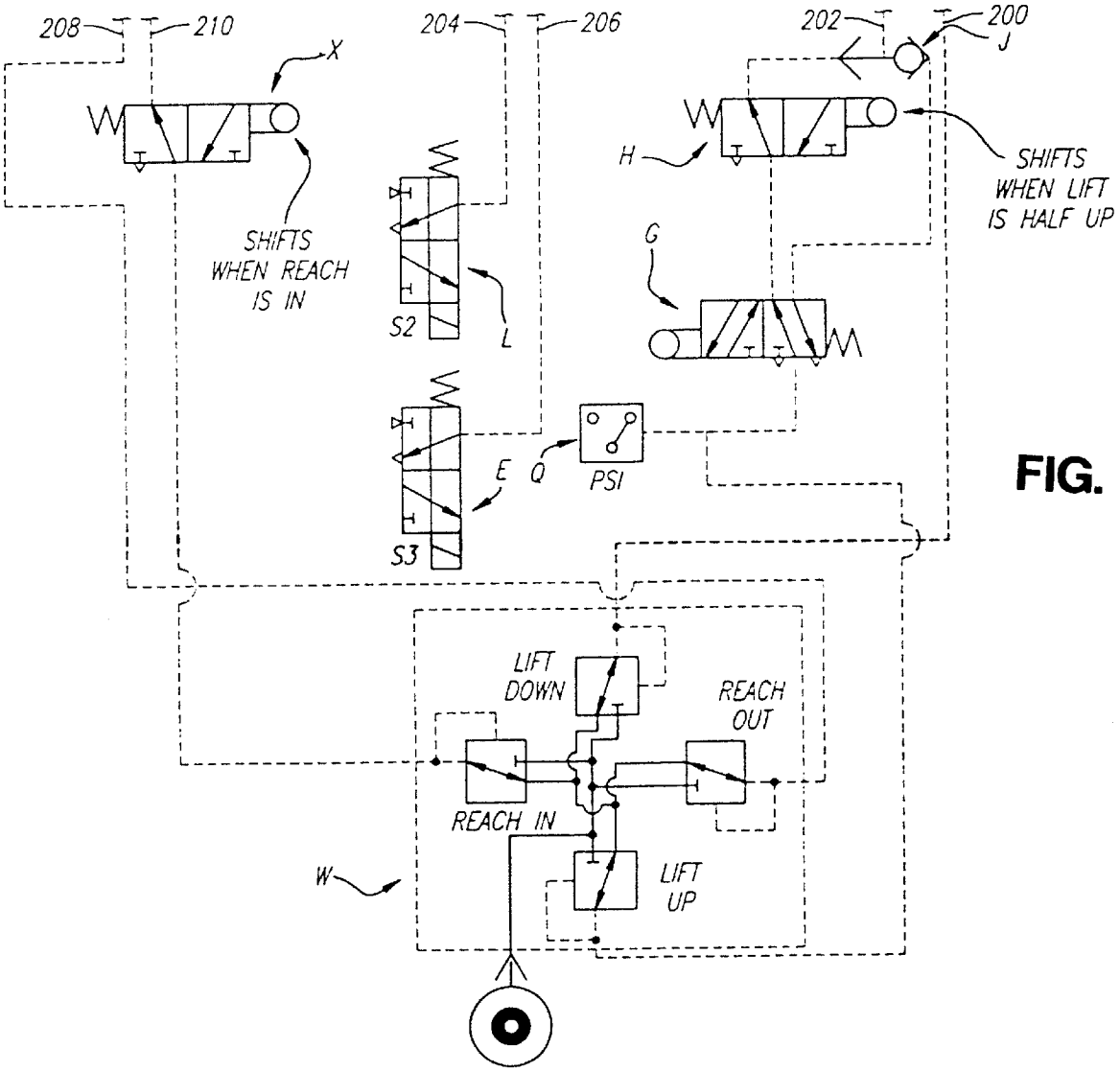

FIGS. 11*a*, 11*b* and 11*c* show portions of a complete hydraulic circuit. Broken lines 200, 202, 204, 206, 208 and 210 connect FIGS. 11*b* and 11*c*. A broken rectangle 212 connects FIGS. 11*a* and 11*b*.

NORMAL OPERATION

The operator drives the vehicle 10 to a container 30 (FIG. 1). If container 30 is too far away for the operator to drive the vehicle 10 directly to container 30, the operator moves the pneumatic joystick or lever W in FIG. 11*c* to the right. The joystick A in FIG. 11*c* corresponds to the lever 54 in FIG. 1. This allows air pressure to be provided into the rod end of the actuator for a reach cylinder valve Y in FIG. 11*b*. Valve Y shifts. Oil from the pump in FIG. 11*a* flows into the head end of the Reach Cylinder in FIG. 11*b*. This swings lift arm 40 outwardly to the position shown in FIG. 10. When gripping members 38 in FIG. 2 are close to storage container 30, the operator returns joystick W to the center position. This vents the head end of the actuator of the valve Y in FIG. 11*b* and the springs in the valve return the actuator to the center position, thereby discontinuing oil flow to the Reach Cylinder.

Figure 13:
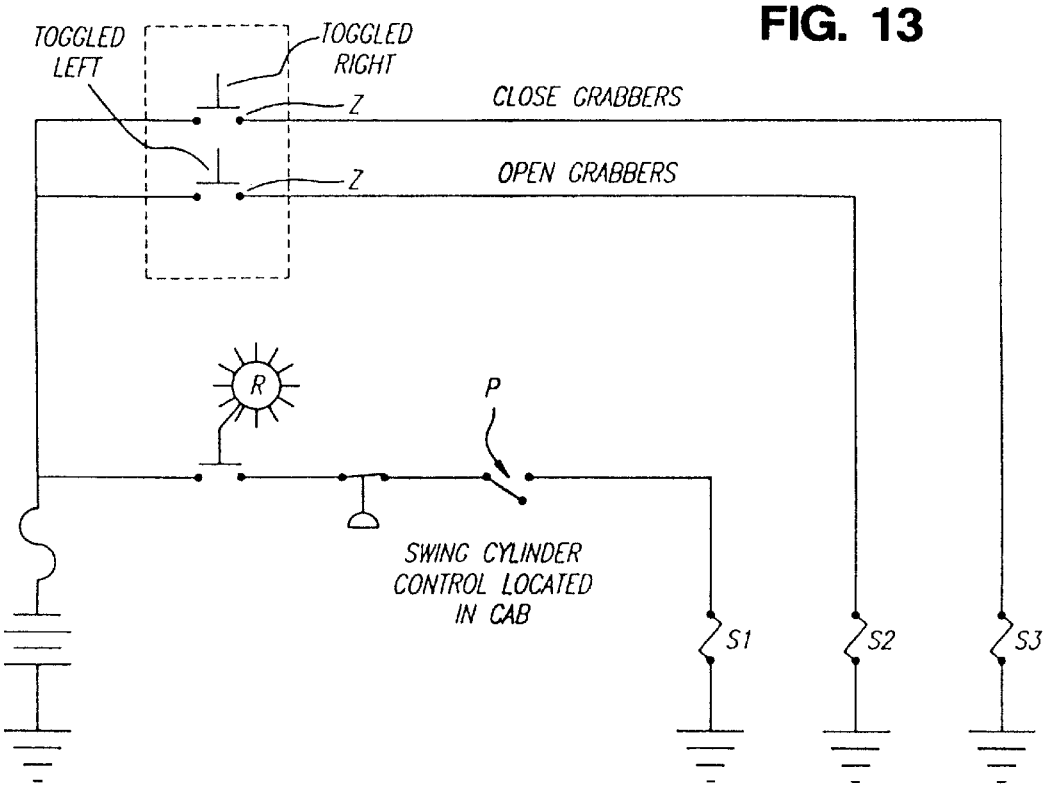
FIG. 13 is a schematic circuit diagram of an electrical circuit for controlling the operation of the fluid pressure control circuits shown in FIGS. 11 and 12.

The operator pushes the toggle right switch (FIG. 13) located on the top of the joystick W. This energizes a solenoid S3 in the electrical circuit (FIG. 13). The solenoid S3 shifts a valve E in FIG. 11*c*. Air pressure is allowed into the rod end of the actuator for a grabber valve F (as indicated by the broken line 206 extending between the valves E in FIGS. 11*c* and F in FIG. 11*b*). The grabber valve F shifts such that oil flows into the head end of the grabber cylinder, closing the grabbers 38. The operator deactivates the toggle switch in FIG. 13 and the spring in the valve F in FIG. 11*b* returns the valve to neutral.

The operator now pulls the joystick W in FIG. 11*c* back and to his left. This allows air pressure into two places: the reach-in and lift-up portion of the joystick circuit. The "reach-in" air pressure passes through a reach position sensing valve X in FIG. 11*c* to the base end of the actuator for the reach cylinder valve Y in FIG. 11*b*. The air for lifting lift arm 40 passes through a reach position sensing valve G in FIG. 11*c*, through a lift position sensing valve H in FIG. 11*c*, and through a shuttle valve J in FIG. 11*c* into the rod end of the actuator for a lift cylinder valve K in FIG. 11*b*. Oil flows through the reach cylinder valve Y to the rod end of the reach cylinder and lift arms 40 begin to swing into the position D in FIG. 10. Oil also flows through the lift cylinder valve K in FIG. 11*b* and into the base end of the lift cylinder 78 (FIGS. 6–7). Lift arm 40 begins to rise.

During the raising and lowering of lift arm 40, two master-slave cylinder circuits operate. They are 1) a grabber arm dump circuit M (FIG. 12); and 2) a grabber arm swing in-out circuit N in (FIG. 11*a*). They operate as described below.

THE GRABBER ARM DUMP CIRCUIT M (FIG. 12)

The master dump cylinder in FIG. 11*a* is driven by two ears that extend from the lift arm cross-shaft. These ears drive master dump cylinder 122 in and out relative to the rotation of the main arm. Master dump cylinder 122 is extended as lift arm 40 rises. An ⅛" extra stroke on master dump cylinder 122 insures that the master and slave dump cylinders 122 and 110 remain synchronous in cycle after cycle. The oil from the ⅛" extra stroke of master cylinder 122 flows over the cross port relief valve (216) to tank, and the other end of the master cylinder sucks oil from the tank. Slave dump cylinder 110 controls the grabber arm 38 dump motion. As lift arm 40 begins to lift container 30, master cylinder 122 contracts. This extends slave cylinder 110 keeping grabber arm 38 level as lift arm 40 continues to lift container 30. Once the ears of master cylinder 122 have crossed over center, the master cylinder begins to extend.

THE GRABBER ARM SWING IN-OUT CIRCUIT N (FIG. 11*a*)

The master swing cylinder 90 in FIG. 11*a* is driven by two ears that extend from the main arm 40. These ears drive master swing cylinder 90 in and out relative to the rotation of main arm 40. Master swing cylinder 90 is extended as lift arm 40 raises the container 30. There is a ⅛" extra stroke on master swing cylinder 90. This insures that the master and slave swing cylinders 90 and 66 remain synchronous cycle after cycle. The oil from the ⅛" extra stroke of master cylinder 90 flows over a relief valve to tank and the other end of master cylinder 90 sucks oil from the tank through the check valve. Slave cylinder 66 controls the grabber arm 38 swing in-out motion. At full extension of slave cylinder 66, grabber arm 38 is fully swung into the close-in position.

It should be noted that the swing in-out cylinder circuit has two additional valves. These will be discussed later under alternate operating modes. Throughout the remainder of this explanation, it will be presumed that these two circuits are acting in accordance with the above description unless otherwise noted.

If the joystick or lever 54 (or W in FIG. 11*c*) is in the lower left quadrant as seen in FIG. 11, the reach cylinder fully retracts at approximately the same time that lift arm 40 is half way up (considered to be 30°).

Both the reach position sensing valve G in FIG. 11*c* and the lift position sensing valve K in FIG. 11*b* shift as pick-up arm 32 moves completely in to the close-in position and is halfway up toward the off-load position. The air pressure now goes through lift position sensing valve G in FIG. 11*c* and bypasses reach sensing valve H in FIG. 11*c*. Shuttle valve J in FIG. 11*c* now shifts and air pressure continues to the rod end of the actuator for the lift cylinder valve K in FIG. 11*b*. Oil continues to flow into the base end of lift cylinder 90 in FIG. 11*a*. Lift arm 40 continues to rise until the container 30 is in the fully dumped position. At this time, the manual control lever on the lift cylinder valve K becomes actuated to return the valve to the neutral position. Lift arm 40 stops.

When the contents of container 30 are dumped into the storage container, the operator moves joystick W into the "up" position in FIG. 11*c*. This allows air pressure to be provided into the base end of the actuator for the lift cylinder valve K in FIG. 11*b*. Valve K shifts, allowing oil to flow into the rod end of lift cylinder 90 in FIG. 11*a*. Lift arm 40 begins to move downwardly. Once lift arm 40 is more than halfway down, the operator moves the joystick into the forward right position in FIG. 11*c*. Lift arm 40 continues to move downwardly and air pressure now goes into the rod end of the actuator for the reach cylinder valve Y in FIG. 11*b*. Valve C shifts, allowing oil to flow into the base end of the reach cylinder. Pick-up arm 32 begins to move outwardly. By adjusting the extent to which the operator moves joystick W to the right position, he/she can determine how far out the reach cylinder moves the lift. An experienced operator can return the container to its original position quite easily.

After container 30 has been returned to the desired position, the operator moves joystick W in FIG. 11*c* to the neutral position and activates the toggle switch (FIG. 13) on top of the joystick. This energizes solenoid S2 which shifts a valve L in FIG. 11*c*. This allows air pressure to be introduced into the base end of the actuator for the cylinder valve F (FIG. 11*b*) of grabber 38. The valve F shifts and oil flows into the rod end of the grabber cylinder and the grabbers 38 (FIG. 2) open. The operator moves joystick W to the left and air under pressure flows through the reach position sensing valve X in FIG. 11*c* and into the base end of the actuator for the reach cylinder valve Y in FIG. 11*b*. The valve Y shifts, allowing oil to flow into the rod end of the reach cylinder. The lift moves in. When the lift is fully reached in, reach position sensing valve (B) shifts cutting off air pressure to the actuator for the reach cylinder valve (C). The spring-centered valve returns to center and the oil flows to the tank.

ALTERNATE OPERATIONS

The most common operation of the Front-Side lift is explained above. There are a few deviations that are available but are not used as frequently. They are now discussed.

Sometimes all the refuse does not fall out of container 30 when the container is lifted to transfer the refuse into storage container 20 through inlet 22. When this happens, the operator would desirably jerk container 30 at the top of the dump cycle. The operator can accomplish this by moving joystick W in FIG. 11*c* back and forth between the forward and rear positions. By moving joystick W forwardly, air under pressure flows into the rod end of the actuator for the lift cylinder valve K in FIG. 11*b*. This valve shifts, allowing oil to flow into the rod end of the lift cylinder (K). Lift arm 40 begins to move downwardly. By moving joystick W to the rear, air pressure passes through the lift position sensing valve G in FIG. 11*c* into the rod end of the actuator for the lift cylinder valve K. The valve K shifts, allowing oil to flow into the base end of lift cylinder 90 and lift arm 40 rises to the dumped position. Again, the manual control lever on the lift cylinder valve K becomes actuated, returning the valve to the neutral position. Lift arm 40 stops at the top of its stroke. The operator can repeat this cycle until all the refuse has fallen out of container 30.

One benefit of the lift arrangement described above is the ability to pick up containers 30 from 1) the side of the track, (2) in front of the truck, or 3) anywhere in between. The first option has been explained above. The description of the two other options follows.

First, located in the cab is a switch P (FIG. 13). When the operator wants to swing grabber arm 38 inwardly and outwardly manually, he initially activates the switch P. This energizes solenoid S1 (FIG. 13) which shifts air valve R. This allows air under pressure to be provided into the base end of the actuator for swing cylinder valve S in FIG. 11*a*. The valve S shifts and transfers control of the swing in-out cylinder 66 from the master swing in-out cylinder 90 to the swing in-out control valve T in FIG. 11*a*. The valve T is controlled by a manual control valve V in FIG. 11*a*. This allows the operator to manually position the grabber arm in any position he needs or desires to access container 30. The operator now toggles the toggle right switch (FIG. 12) on top of joystick W and grabbers 38 close on container 30. The operator now moves joystick W into the bottom position in FIG. 11 and the lift begins the dump motion described above.

ANOMALOUS OPERATIONS

Three (3) anomalies to the normal operation of the Front-Side lift are as follows:

1) The operator can attempt to dump container 30 while lift arm 40 is in a reached-out position. As a precaution, the reach position sensing valve G in FIG. 11*c* and the lift position sensing valve K in FIG. 11*b* operate in concert to assure that the operator cannot fully dump container 30 with lift arm 40 not fully retracted. This ensures that the contents of container 30 are not dumped on anything that is located to the rear of the container.

With proper operation of lift arm 40, the operator will move joystick W to the bottom and left quadrant shown in FIG. 11*c*. This will cause the lift to raise and move in together. If the operator chooses to move joystick W only to the bottom position in FIG. 11*c*, air under pressure will pass to the rod end of the actuator for the lift cylinder valve K in FIG. 11*b*. This valve shifts and lift arm 40 begins to rise. Because the operator has not moved joystick W to the left in FIG. 11, the lift arm will remain reached out. Once the lift arm reaches halfway up (presumed to be 30°), the lift position sensing valve H in FIG. 11*c* shifts, cutting off air pressure to the actuator for the lift cylinder valve K. Lift arm 40 will not continue to lift container 30. At this point, the operator can move joystick W to the left, causing pick-up arm 32 to move fully inwardly. Once lift arm 40 is fully moved in the reach position, sensing valve G in FIG. 11*c* shifts, causing the air under pressure to bypass the lift position sensing valve H in FIG. 11*c*. The operator now can move joystick W to the bottom, causing lift arm 40 to move upwardly.

2) If the operator moves joystick W to the rear and slightly to the left, lift arm 40 will begin to move upwardly and move inwardly. Under this scenario, air pressure for continuing the lift process passes through the reach position sensing valve G in FIG. 11*c* and the lift position sensing valve H. If lift arm 40 reaches the half-way-up position (presumed to be 30°) before the lift arm is fully moved inwardly, the lift position sensing valve (H) shifts, cutting off air pressure to the actuator for the lift cylinder valve K in FIG. 11*b*. The lift arm will not continue to move upwardly. However, because joystick W is slightly to the left of the neutral position in FIG. 11*c*, air under pressure will continue to flow to the base end of the actuator for the reach cylinder valve Y in FIG. 11*b*. Oil will continue to flow to the rod end of the reach cylinder and lift arm 40 will continue to move inwardly. The operator may choose to move joystick W fully to the left in FIG. 11*c*. This would reduce the time required to move lift arm 40 fully inwardly. Once lift arm 40 is fully moved inwardly, the reach position sensing valve G in FIG. 11*c* shifts, causing air pressure to bypass the lift position sensing valve H in FIG. 11*c*. The operator now can move joystick W to the bottom position in FIG. 11*c*, causing lift arm 40 to move upwardly.

3) Under manual operation to swing grabber arm 38 inwardly or outwardly, the operator can begin to dump container 30 while the grabber arm is fully swung out. As a precaution, a safety switch Q in FIG. 11*c* is activated whenever the joystick Q is disposed in the position to lift lift arm 40. Air under pressure opens switch Q which de-energizes a solenoid S1. This returns control of grabber arm 38 swing-in to the master-slave circuit defined by master cylinder 90 and slave cylinder 66 (FIG. 11*a*). Once the refuse in container 30 is dumped into the container 20 and the operator moves joystick W into the position to move lift arm 40 downwardly, switch Q closes and returns control of grabber arm 38 swing in-out to manual control valve Q. This allows the operator to reposition container 30 at the position where the operator picked up the container.

This is quite valuable. When picking up containers 30 in a cul de sac, a significant amount of time is saved if the operator can position the grabber arm in any position rather than being forced to position the entire truck to access the containers. Also, there may be objects that obstruct direct access to a container. Through the combination of the reach and grabber arm 38 positioning, the operator has enhanced flexibility in accomplishing his job.

PRESSURE COMPENSATED VALVE

Due to the use of a pressure-compensated flow control valve (2), a simultaneous volume of oil flow through each section of the valve is possible. This volume can be modified on-site, to maximize the efficiency and performance of each truck.

The pressure compensation feature ensures that oil will flow to all sections regardless of individual loading. For example, if the operator is required to swing lift arm 40 outwardly to retrieve a container, he will want to both lift and swing the lift arm at the same time. The force (and the pressure) required to lift container 30 is greater than that required to swing the arm inwardly. If pressure compensation is not available, all of the flow would be to the section of least resistance, i.e. the swing-in section. Lift arm 40 would swing inwardly until the swing-in cylinder was fully collapsed. Then the pressure would rise in the swing-in section sufficiently to force oil into the lift circuit. This is undesirable. Pressure compensation insures that, in this situation, oil will flow to both sections simultaneously. Lift arm 40 will swing inwardly and lift at the same time. This cuts down the cycle time considerably.

One problem that lift arms with conventional refuse equipment now experience is the production of high forces at the end of the dump cycle due to rapid deceleration. These high forces are well in excess of the static loading applied once the lift arm has come to a stop at the top. The lift cylinder valve K in FIG. 11*b* has a cam actuator opposite the air actuator. This valve is mounted such that this valve is returned to center at the top of the dump cycle. The cam begins to actuate prior to the end of the dump cycle. As lift arm 40 continues to rise toward the end of the cycle, the cam gradually shifts the lift cylinder valve inwardly toward a center position. This is a gradual process and causes a gentle deceleration of the dump motion of lift arm 40 and container 30 at the top of the lift arm movement. This causes container 30 to decelerate slowly and thus reduce the deceleration forces at the top. Even when the master-slave dump circuit is replaced with a linkage, gradual deceleration occurs because lift arm 40 is decelerating and the linkage is controlled by the rotation of the lift arm.

EXPLANATION OF OPERATION OF PARTICULARLY PREFERRED EMBODIMENT (FIGS. 14–26)

The operation of the particularly preferred embodiment of the automated refuse vehicle 10 of the present invention will now be described. Referring now to FIGS. 14–18 and 14*a*–18*a*, lift assembly 34, including lift arm 40, is similar in function and operation to the lift assembly shown in FIGS. 1–12, with the differences noted below, the most important of which concerns the modification to front arm 44 shown in FIGS. 14–22.

Figure 14:
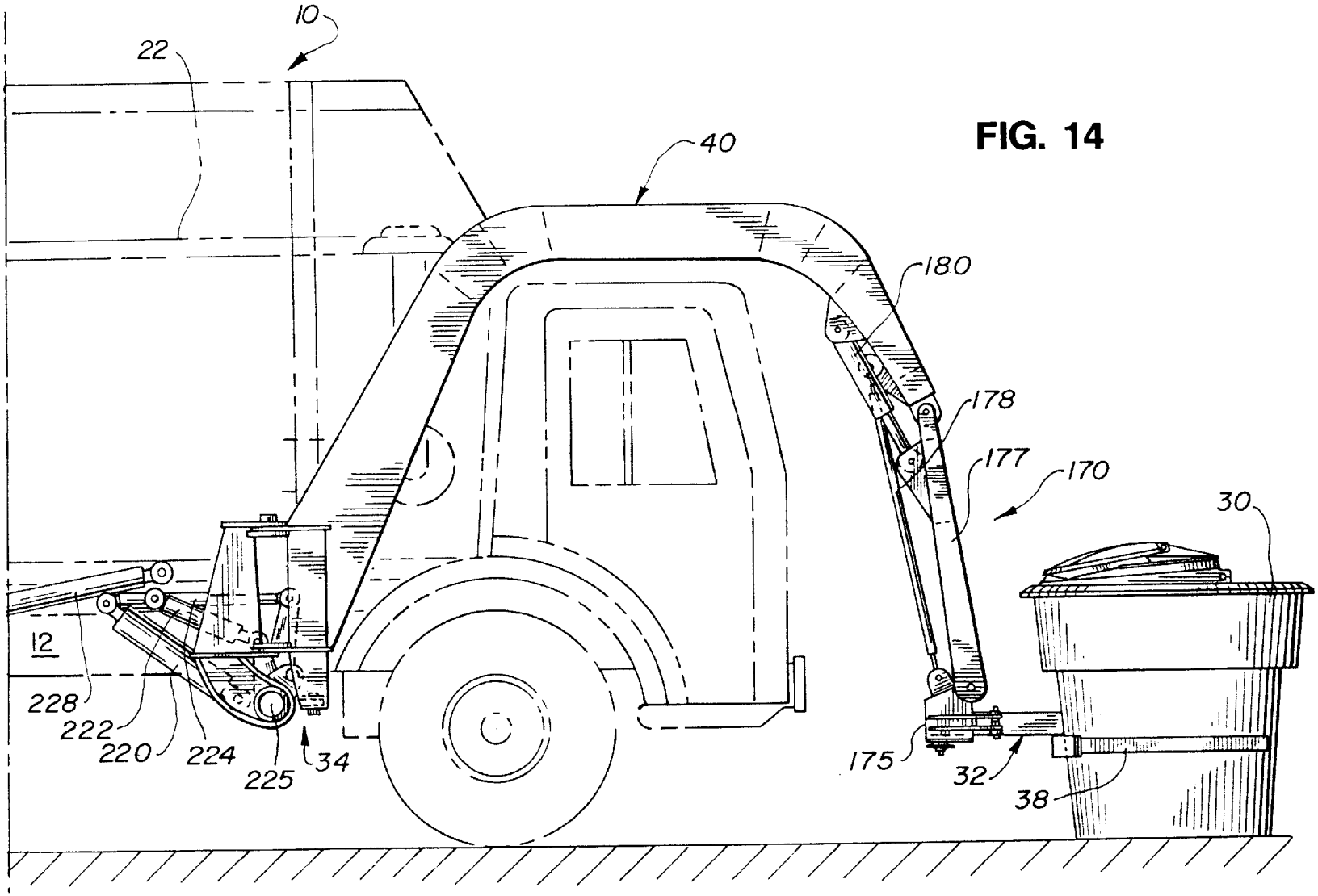
FIGS. 14–18 are side views of an alternative, particularly preferred embodiment of the present invention, showing the sequential operation of the lifting and loading assembly in raising a collection container to an off-load position.
Figure 14A:
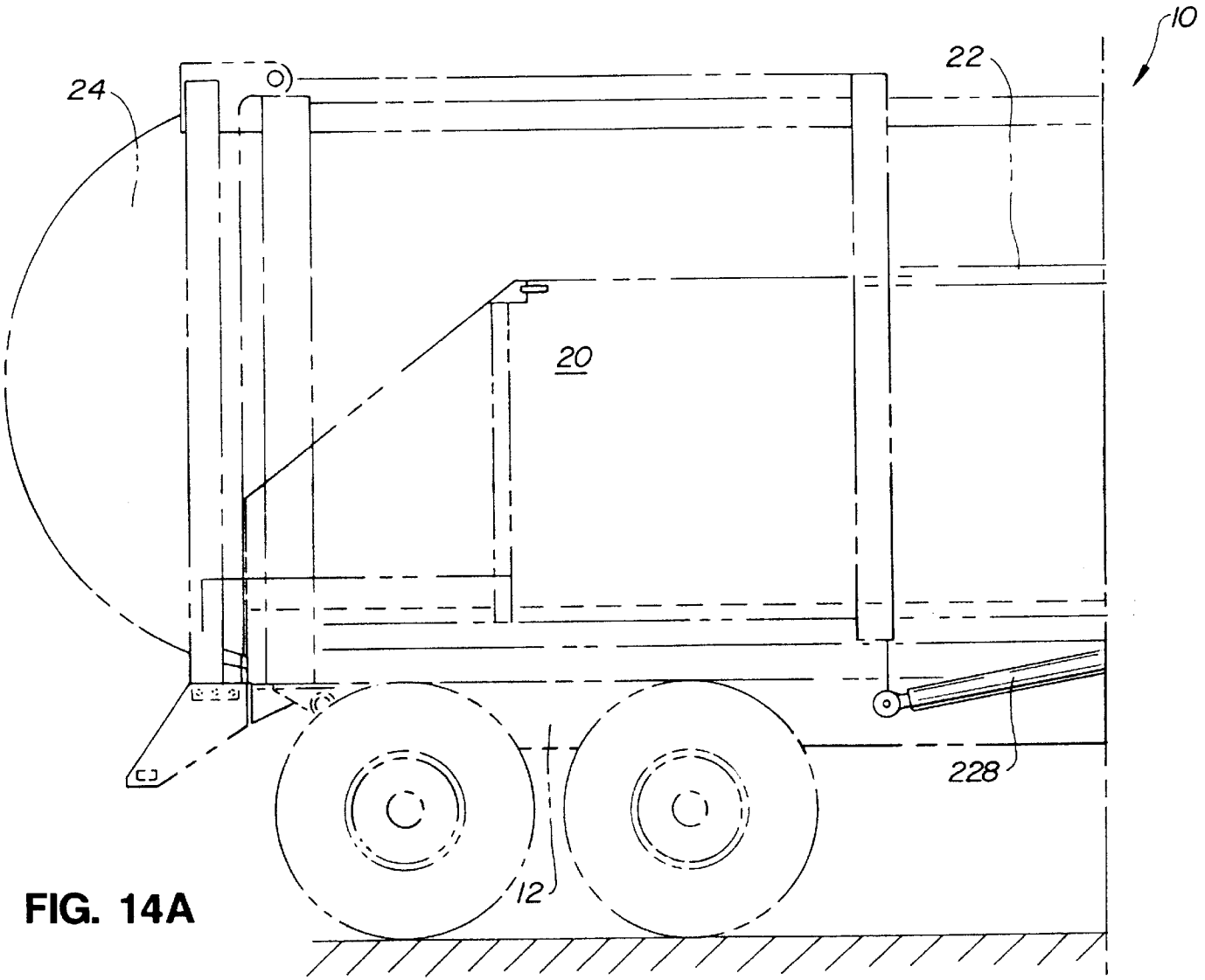
Figure 15:
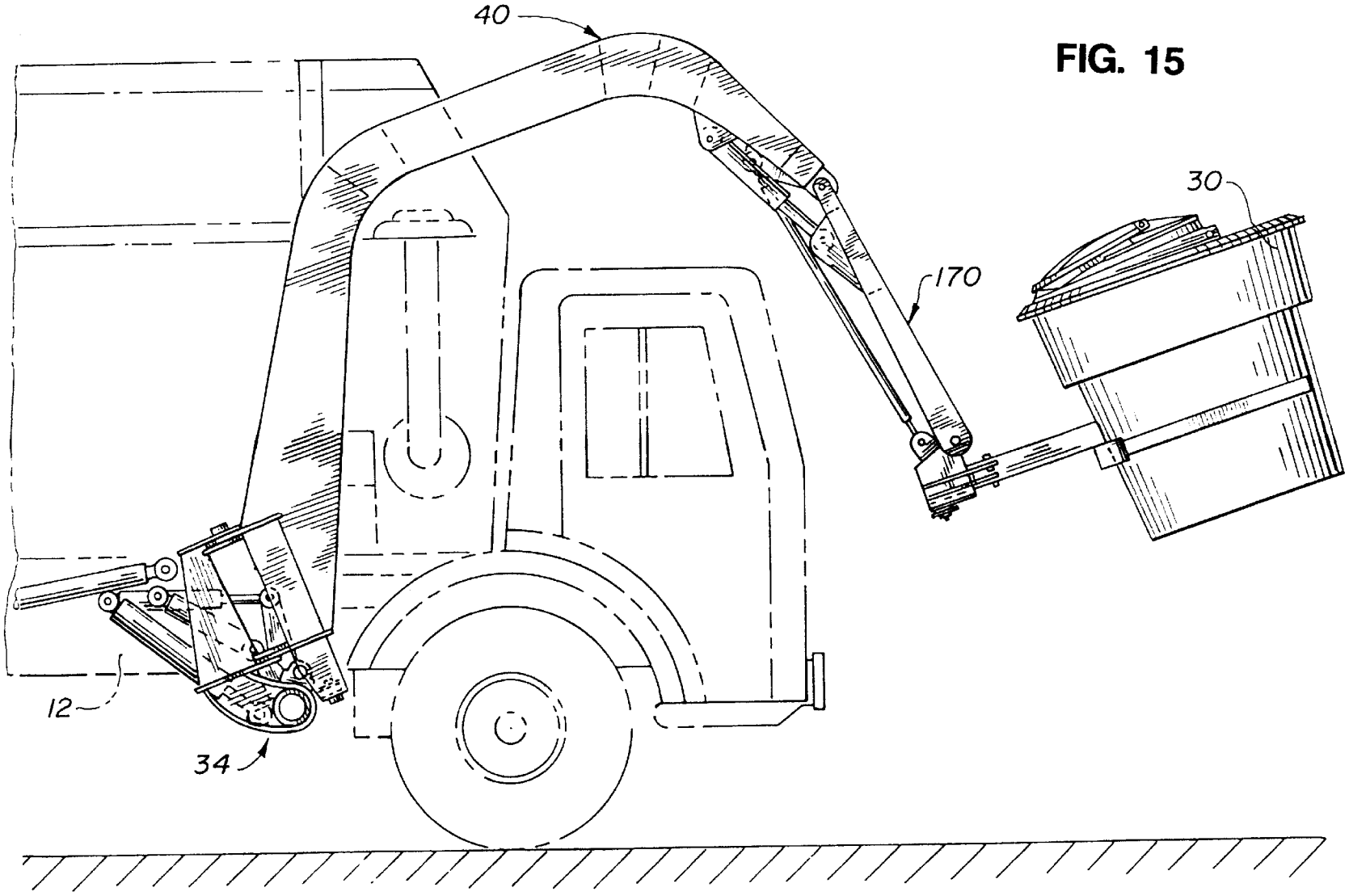
Figure 16:
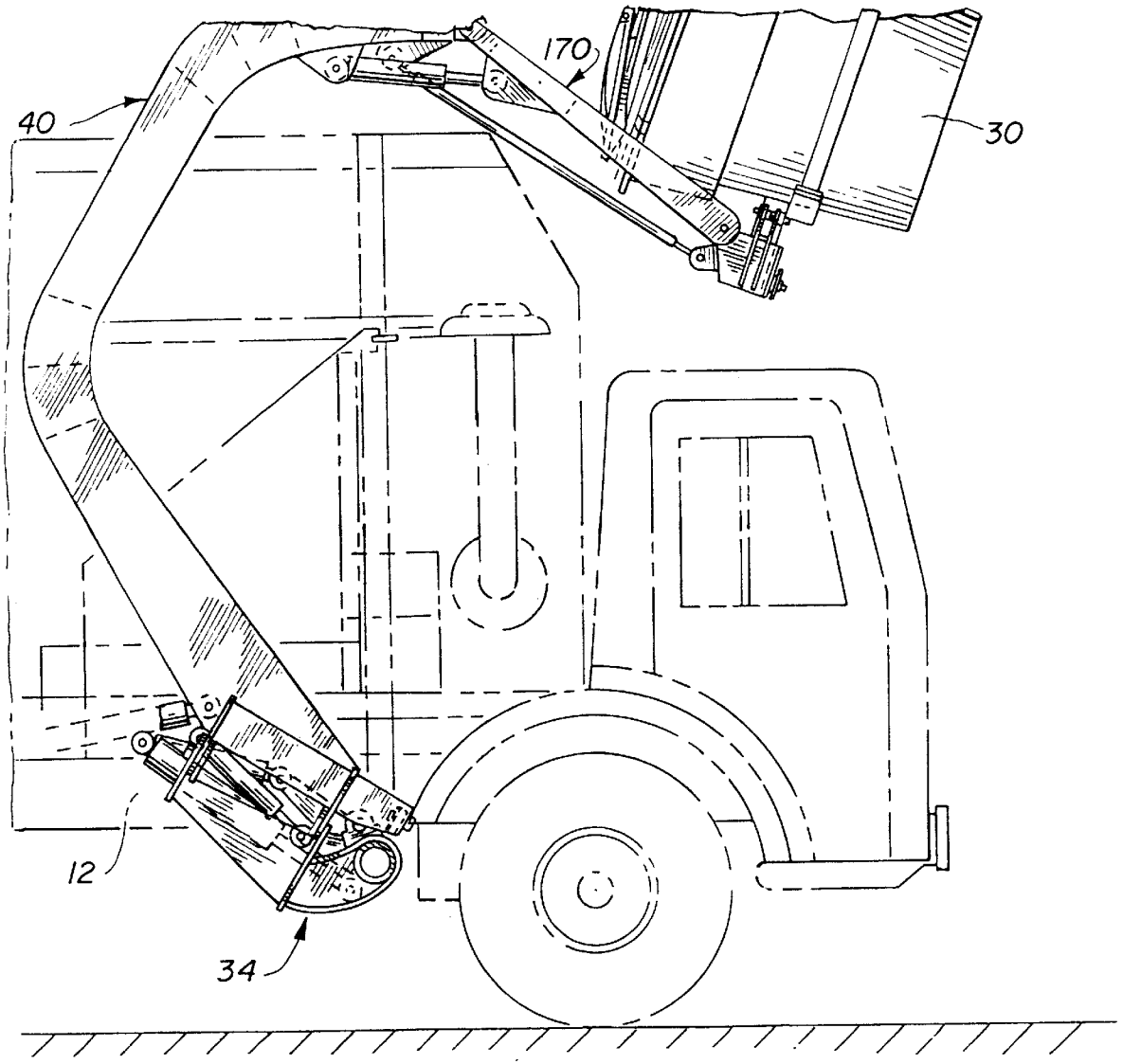
Figure 20:
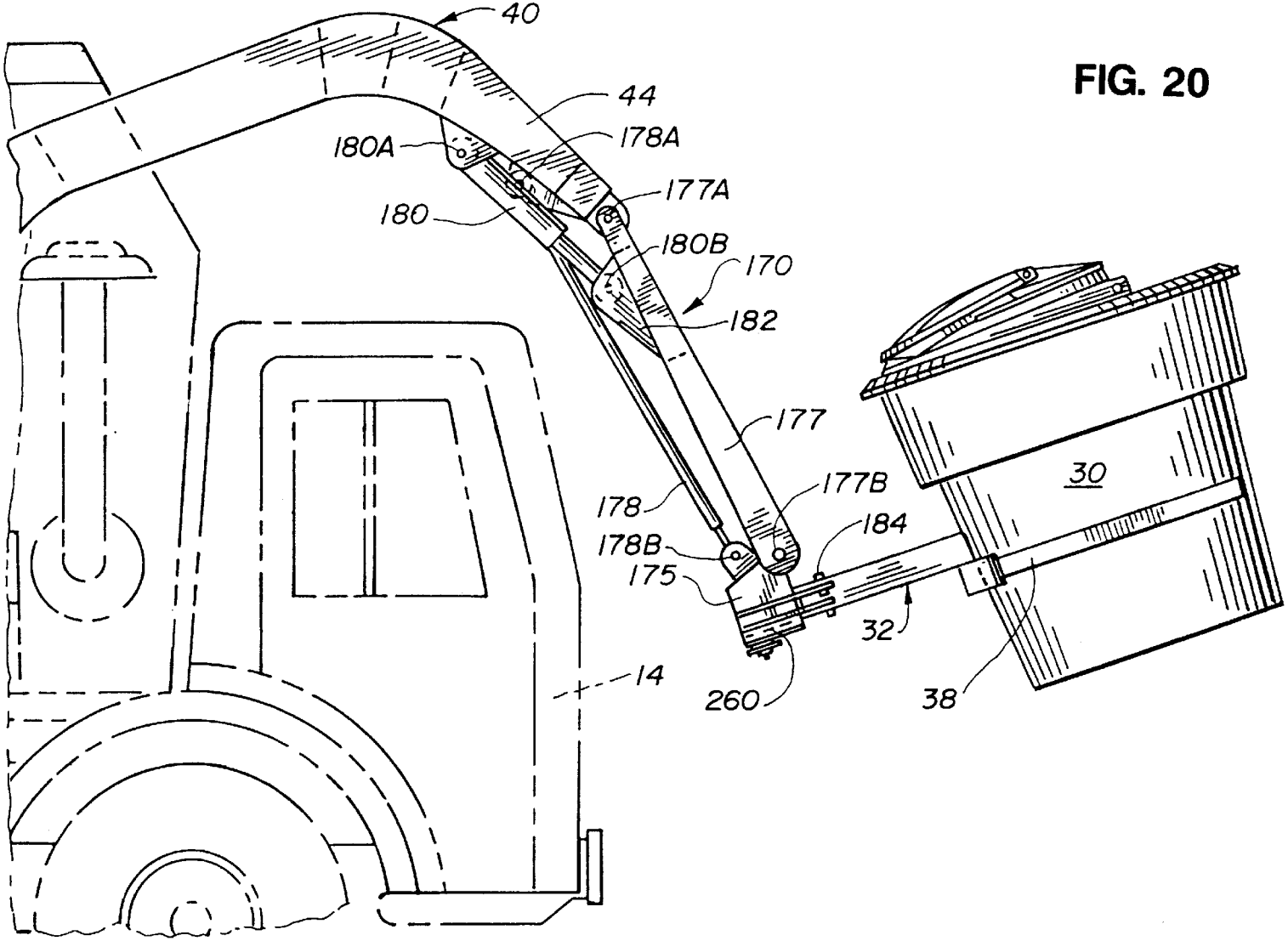
Figure 21:
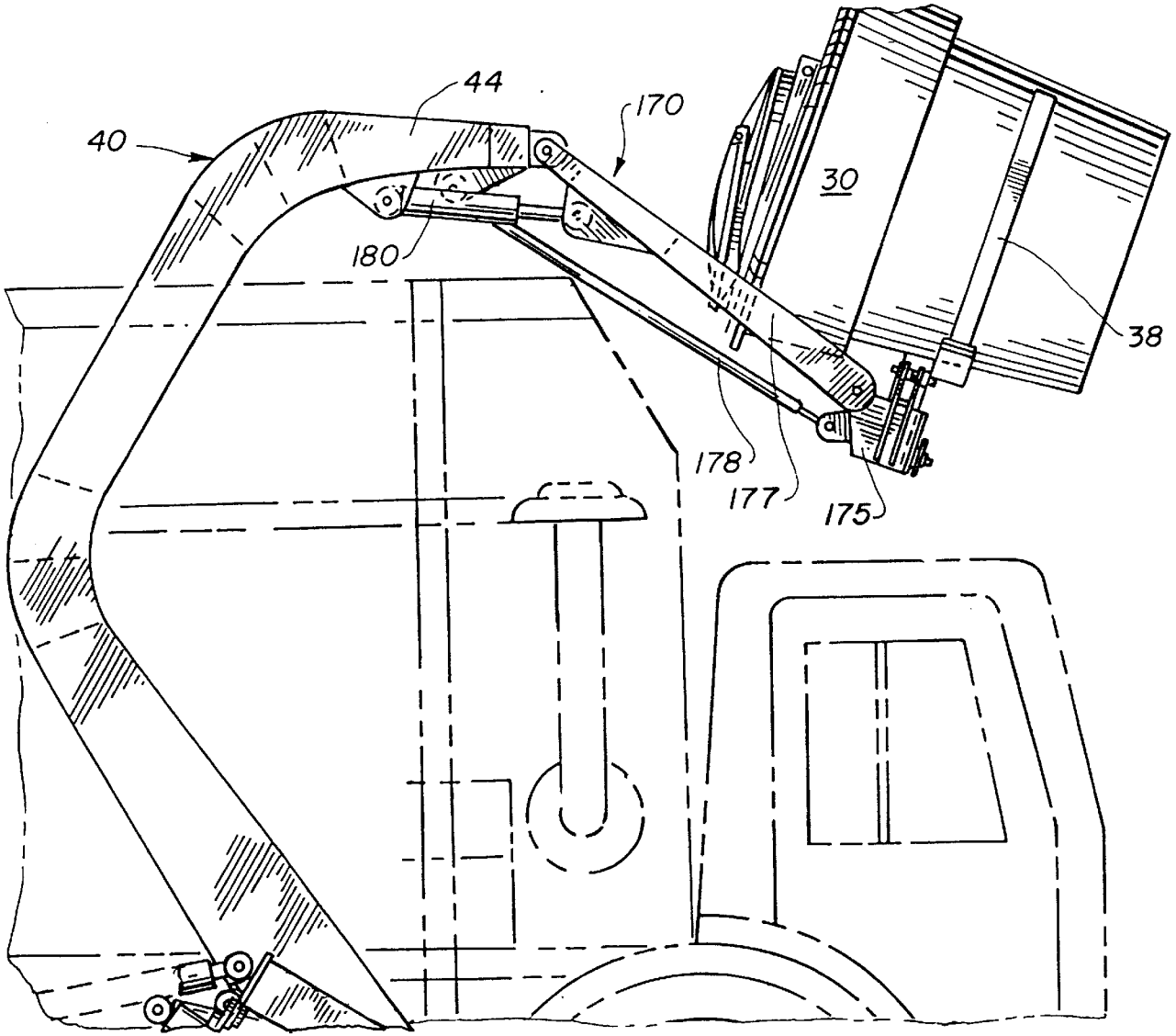
Figure 23:
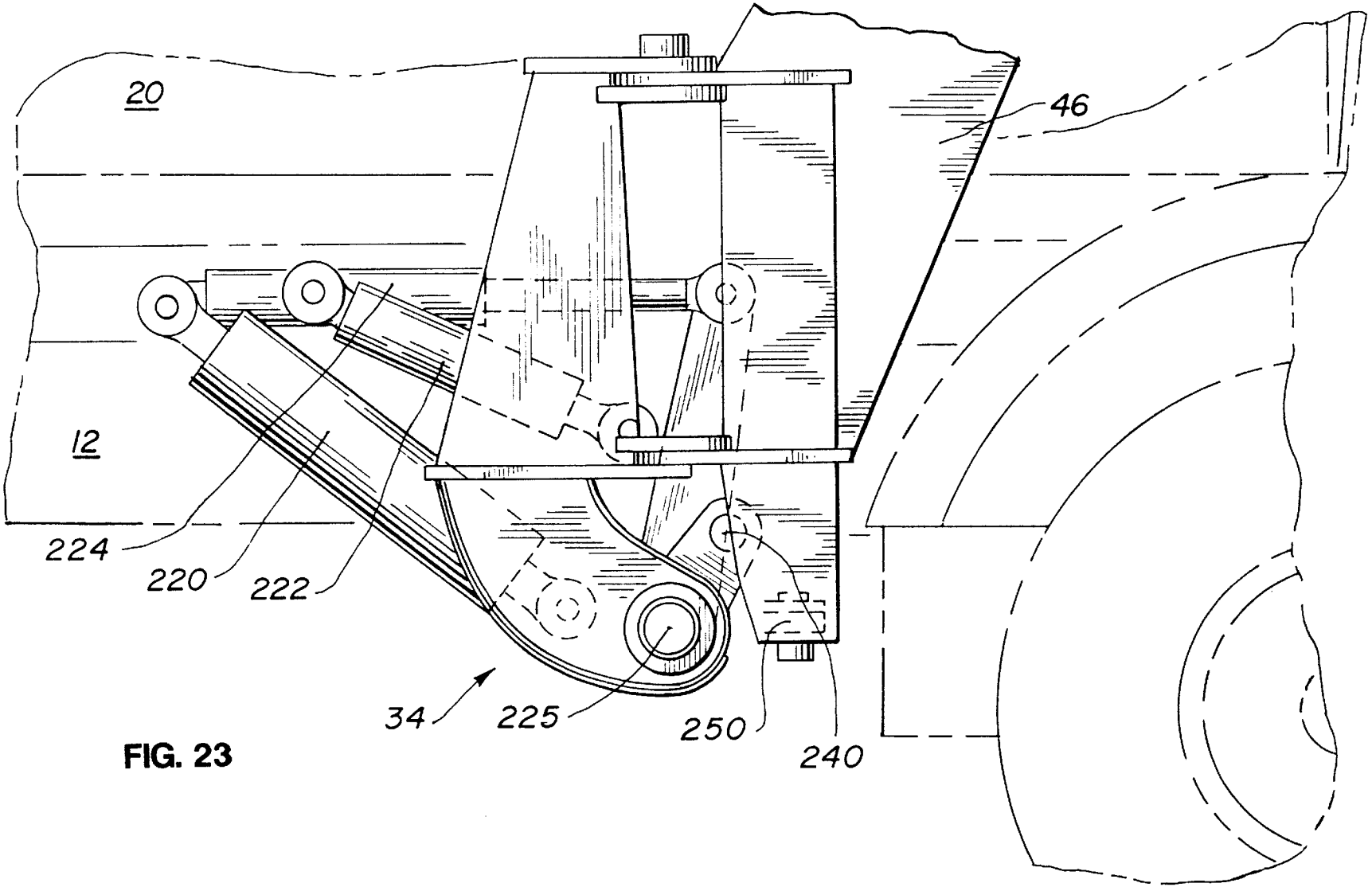
FIGS. 23–26 are exploded, side views of a rear portion of the lift arm and associated hydraulic cylinders of the embodiment shown in FIGS. 14–18, illustrating the sequential operation of a different portion of the lifting and loading assembly in raising a collection container to an off-load position.

As shown in FIGS. 14–18, lift arm cylinder 220 controls the rotational movement of lift arm 40. Referring to FIGS. 14, 20 and 23, for example, the dump master and slave cylinders are 222 and 180, respectively. The swing master cylinder is 224; the swing dump cylinder is associated with pick-up arm 32, though not shown (the swing dump cylinder connects pin 184 on dump link to a point (also not shown) on pick-up arm 32). It will now be understood that master/slave dump cylinders 222, 180 cause the rotation of front link 177 as shown sequentially in FIGS. 14–18. This rotational movement is counterclockwise during container movement from load to about cab-height positions, and clockwise thereafter until dumping. (Of course, this counterclockwise movement to level the container is not required, and in alternative embodiments need not be used.) Similarly, the master/slave swing cylinders actuate the lateral swing of pick-up arm 32; during this movement, pick-up arm 32 pivots about pin 260 on dump link 175. Also, a grabber cylinder (not shown) can actuate grabber arms 38 to engage container 30.

Figure 23A:
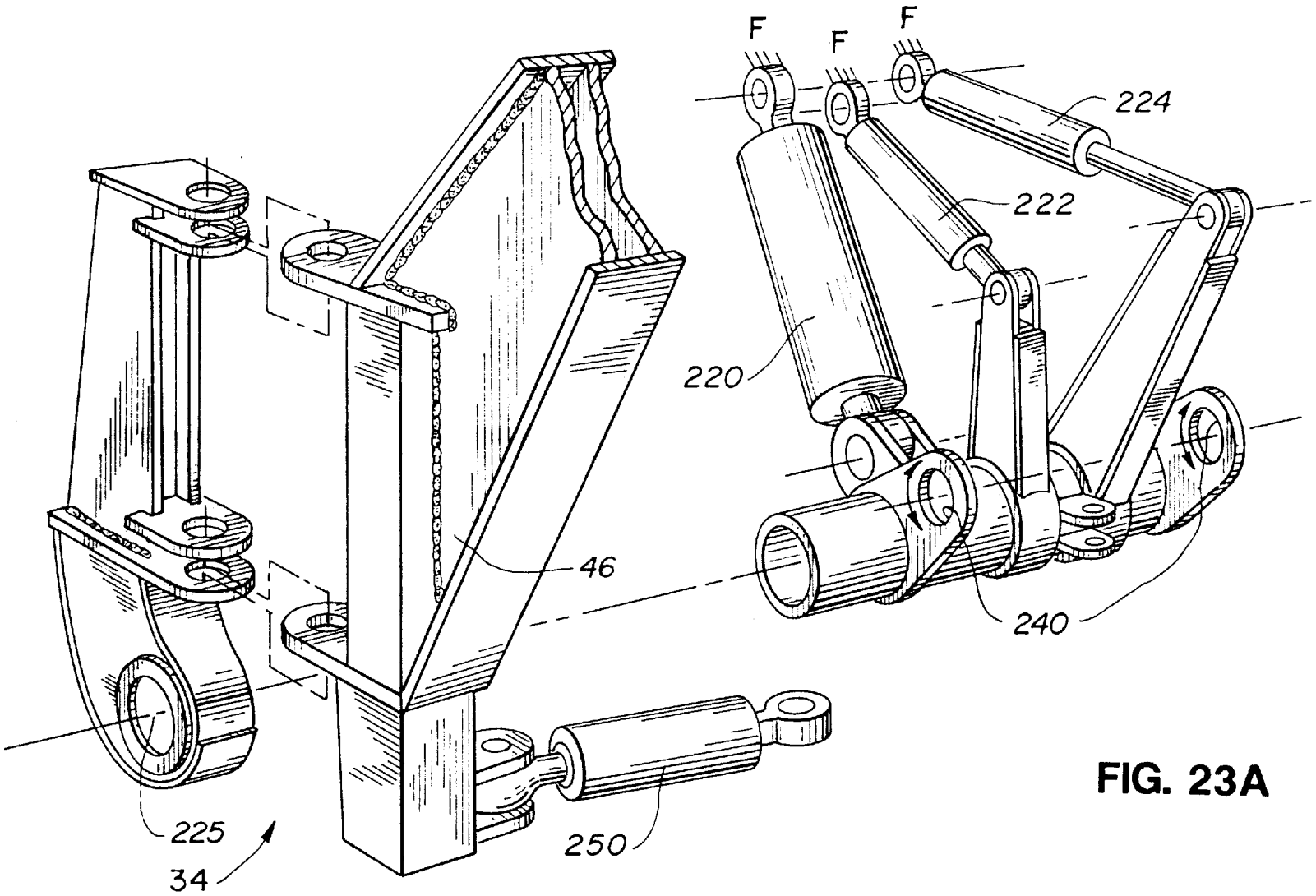
Figure 24:
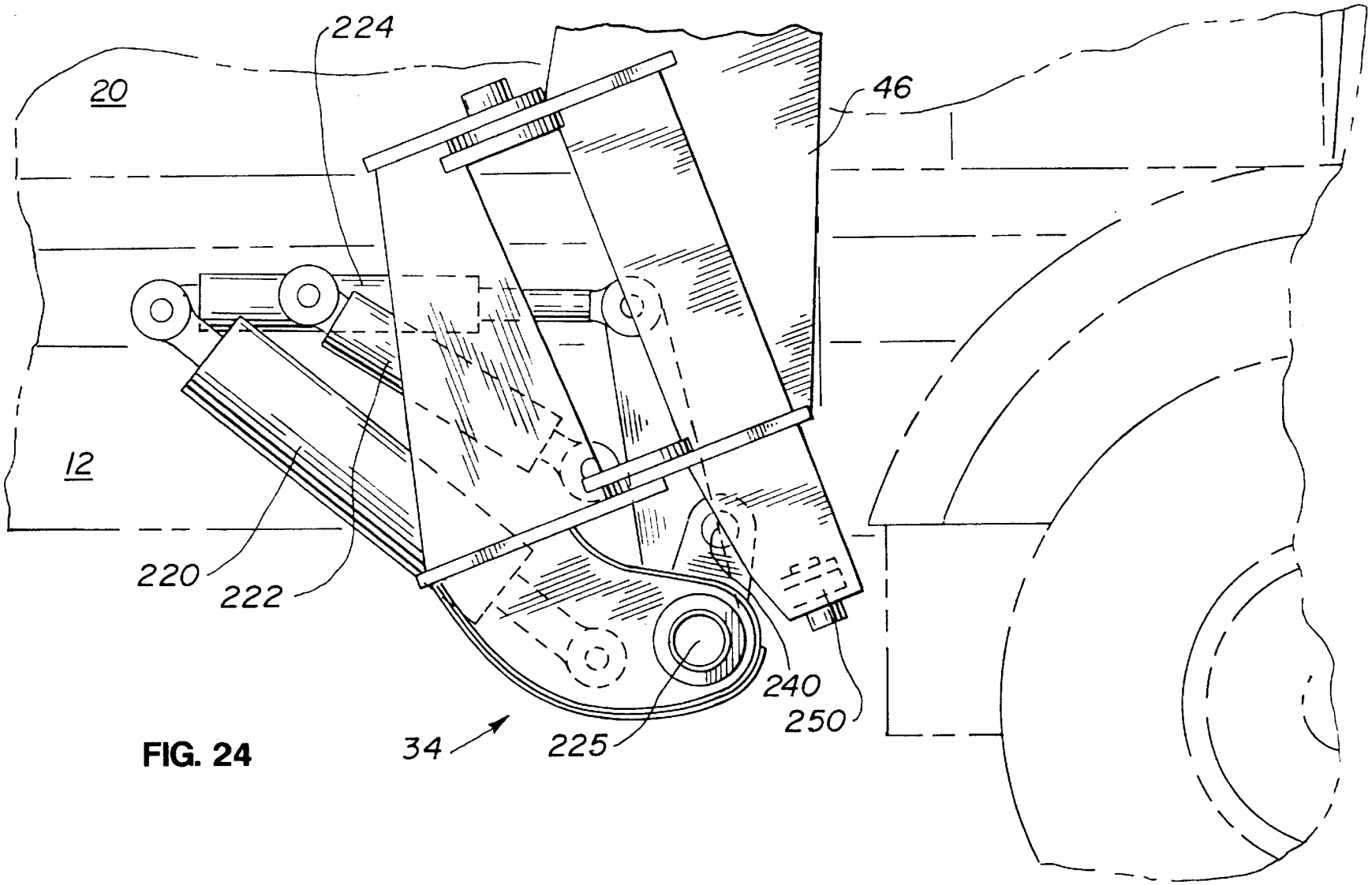
Figure 25:
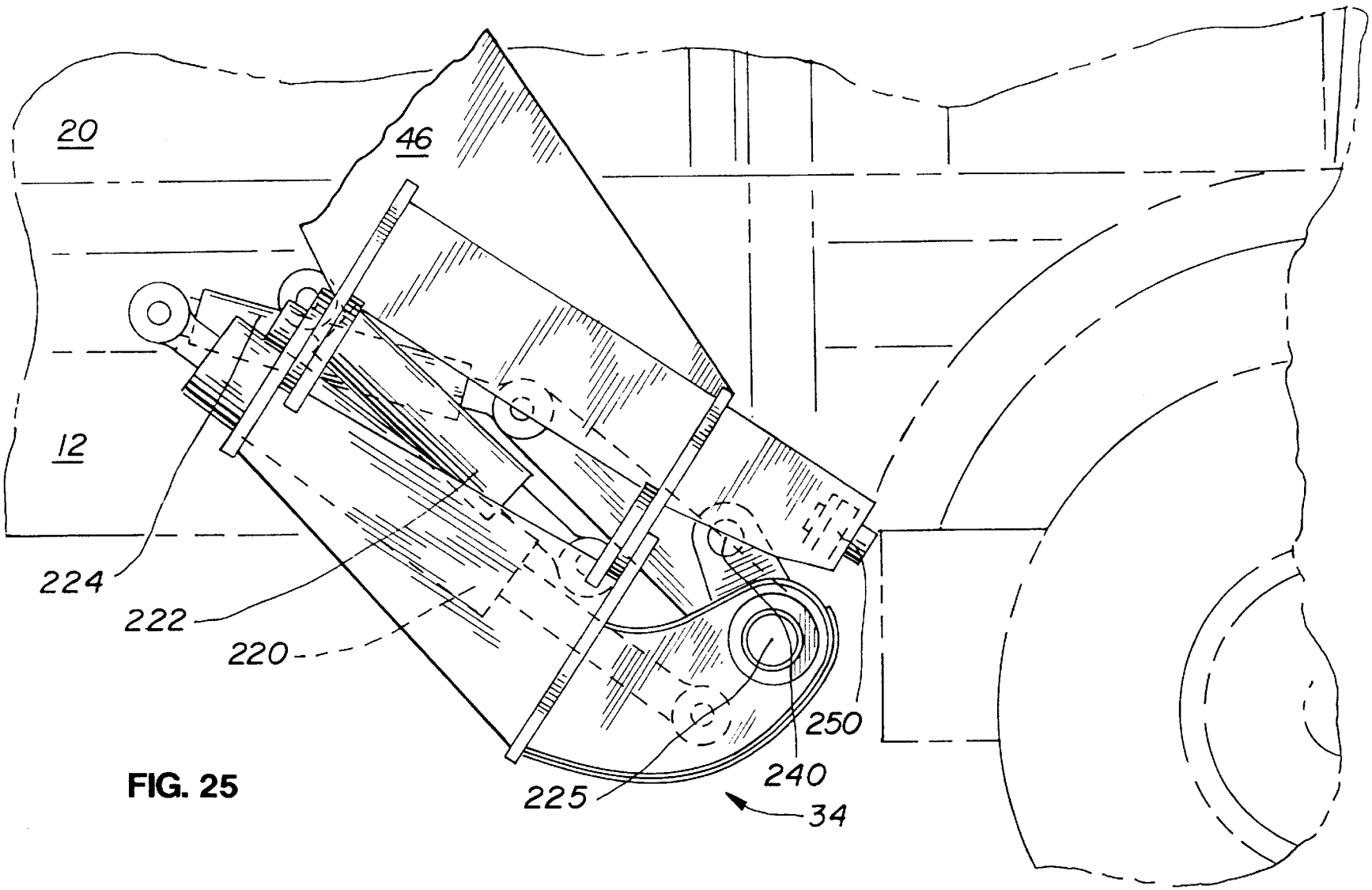
Figure 26:
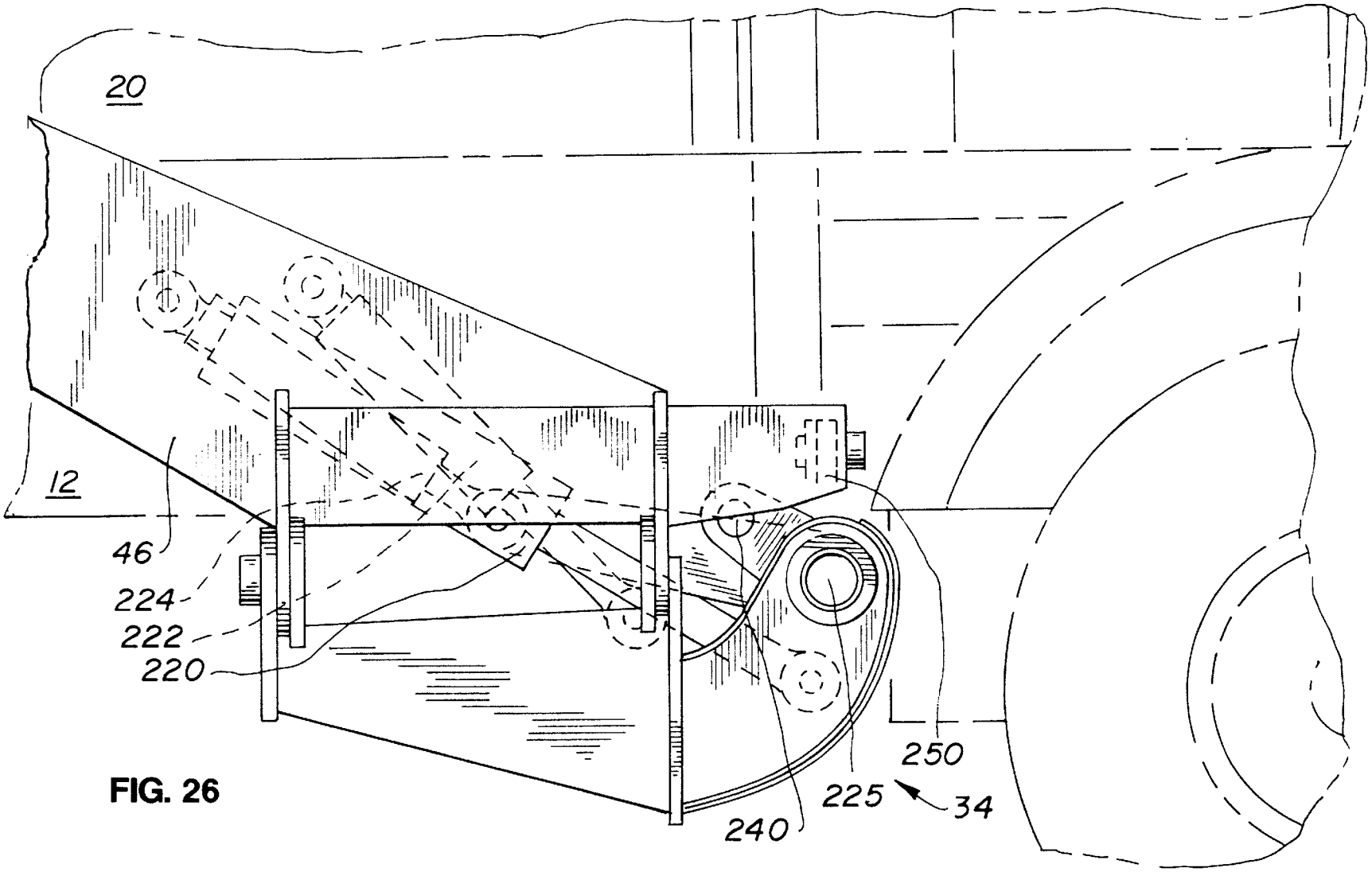
Figure 27A:
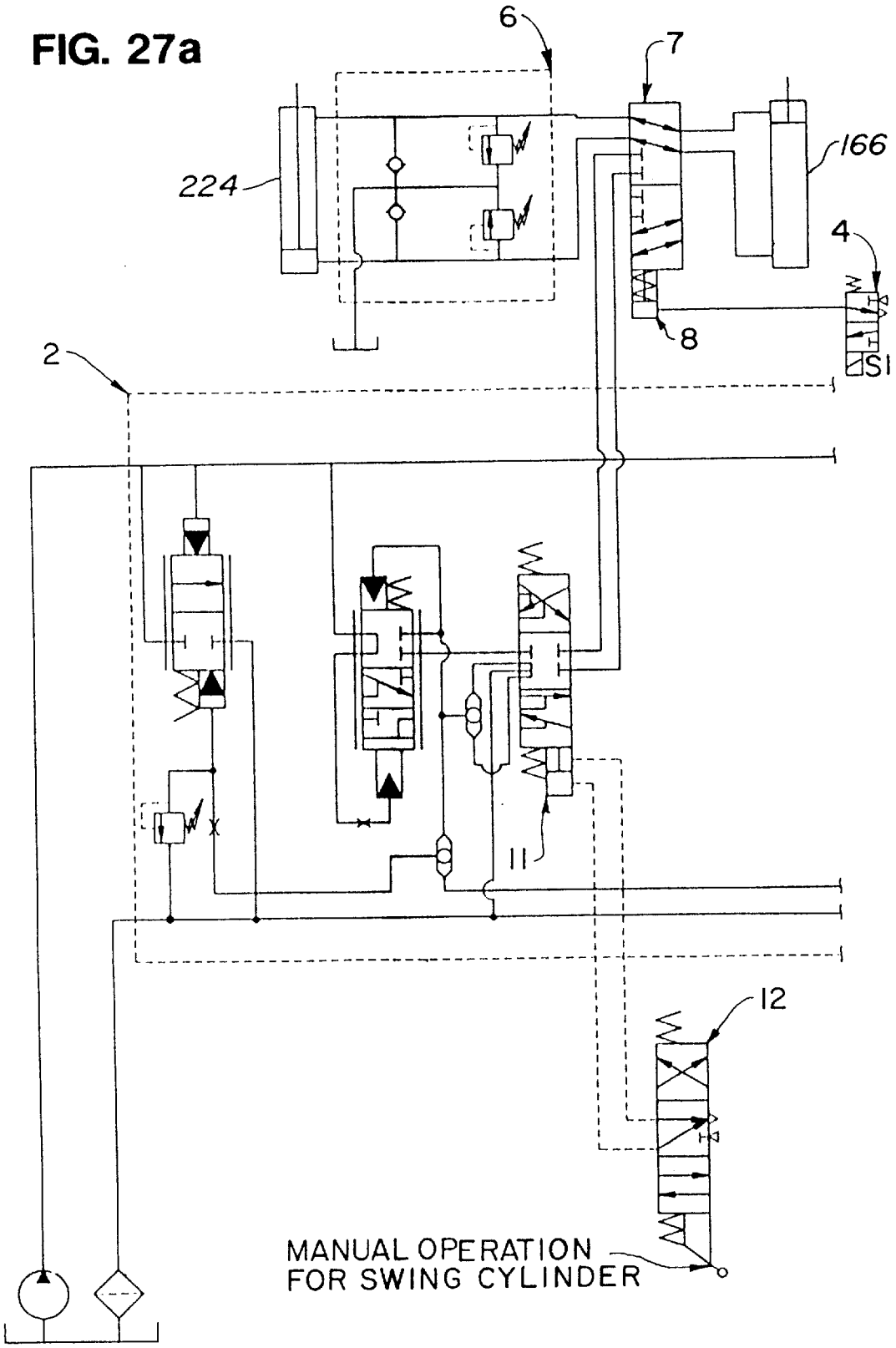
FIGS. 27*a–d* are schematic diagrams of fluid pressure control circuits and an electrical circuit associated with the lifting and loading assembly shown in FIGS. 14–26.
Figure 27B:
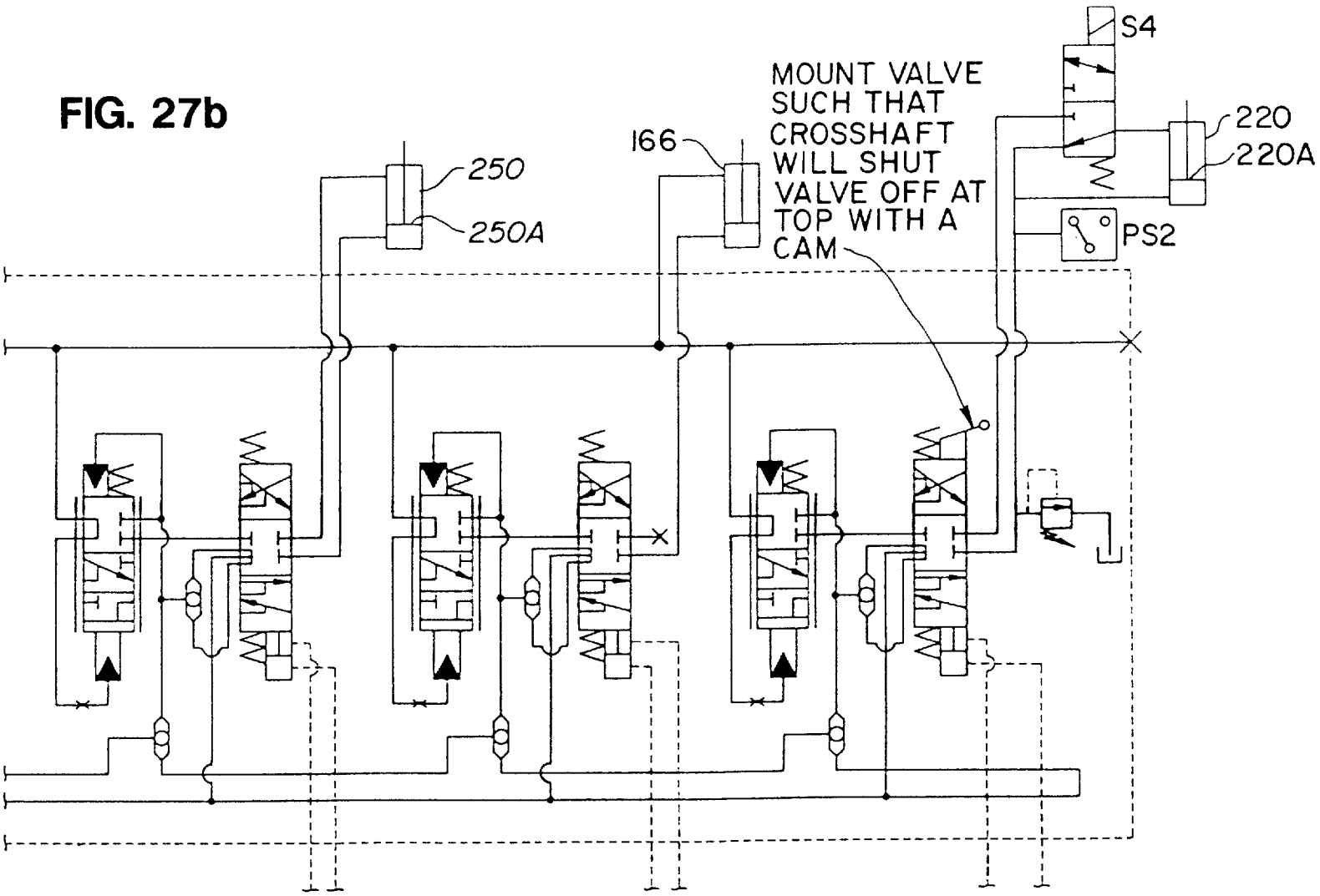
Figure 27C:
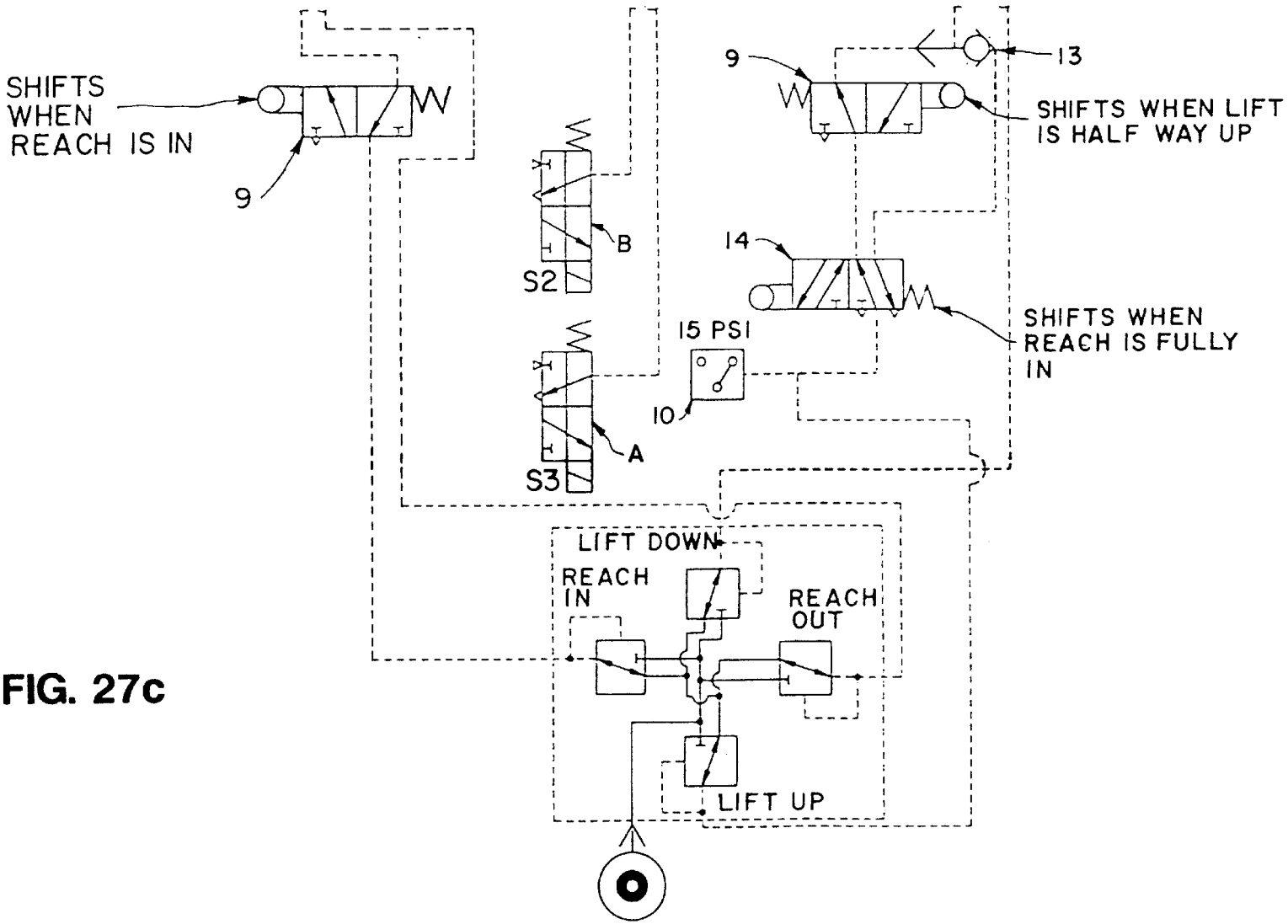
Figure 27D:
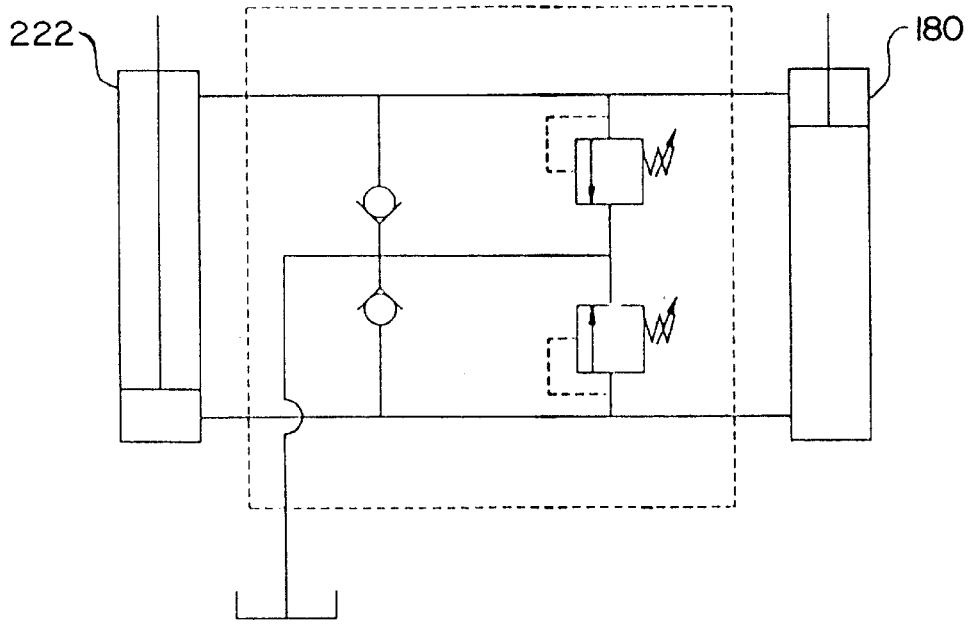
Figure 27D:
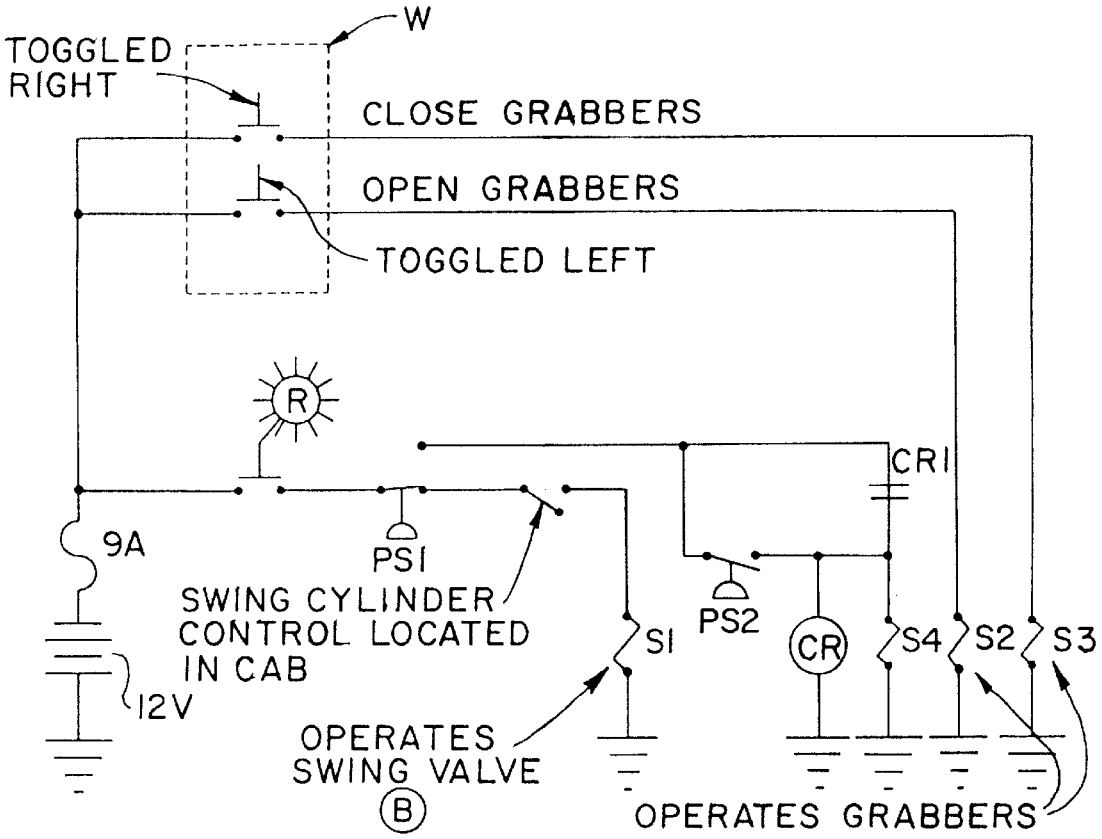

Referring back to FIGS. 14 and 23, for example, a relatively large diameter tube 225 is pivotally connected to the container body at main pin 240. The ears of the cylinders 220, 222, 224 are pivotally connected to the ears off of tube 225, as best shown in FIG. 23*a*. Still referring to FIG. 23*a*, tube 225 pivots about main pivot 240; main pivot 240 pivotally attaches the entire lift assembly 34 to container body 20. Reach cylinder 250, also shown in FIG. 23*a*, actuates the swinging movement of lift arm 40 to and from the curbside.

Using the lift assembly for lift arm 40 shown in FIGS. 1–10, lift arm 40 will only rotate through 90°. However, referring again to FIG. 20, use of the lift arm link assembly, designated generally as 170, which includes dump link or "knuckle" 175 and the four-bar linkage described below, enables the container to be rotated through 135°; this includes 90° of rotation due to the rotation of the lift arm about main pivot 240, and an additional 45° of rotation due to the clockwise movement of front link 177 with respect to lift arm 40. This structure and its movement will now be further explained.

Referring to FIG. 20, the clockwise movement of front link 177 with respect to lift arm 40 (shown sequentially in FIGS. 19–22) is permitted by the four-bar linkage of front link 177 and stabilizer link 178, connected at these four points: 177A, 177B, 178B and 178A. Thus, a top portion of front link 177 is pivotally connected to lower portion 44 of lift arm 40 at pivot pin 177A, while a lower portion of front link 177 is connected at pivot pin 177B to dump link 175. Similarly, a top portion of stabilizer link 178 is pivotally connected to a lower portion 44 of lift arm 40 at pin 178A, while lower portion of stabilizer link 178 is pivotally connected at pivot pin 178B to dump link 175.

Figure 17:
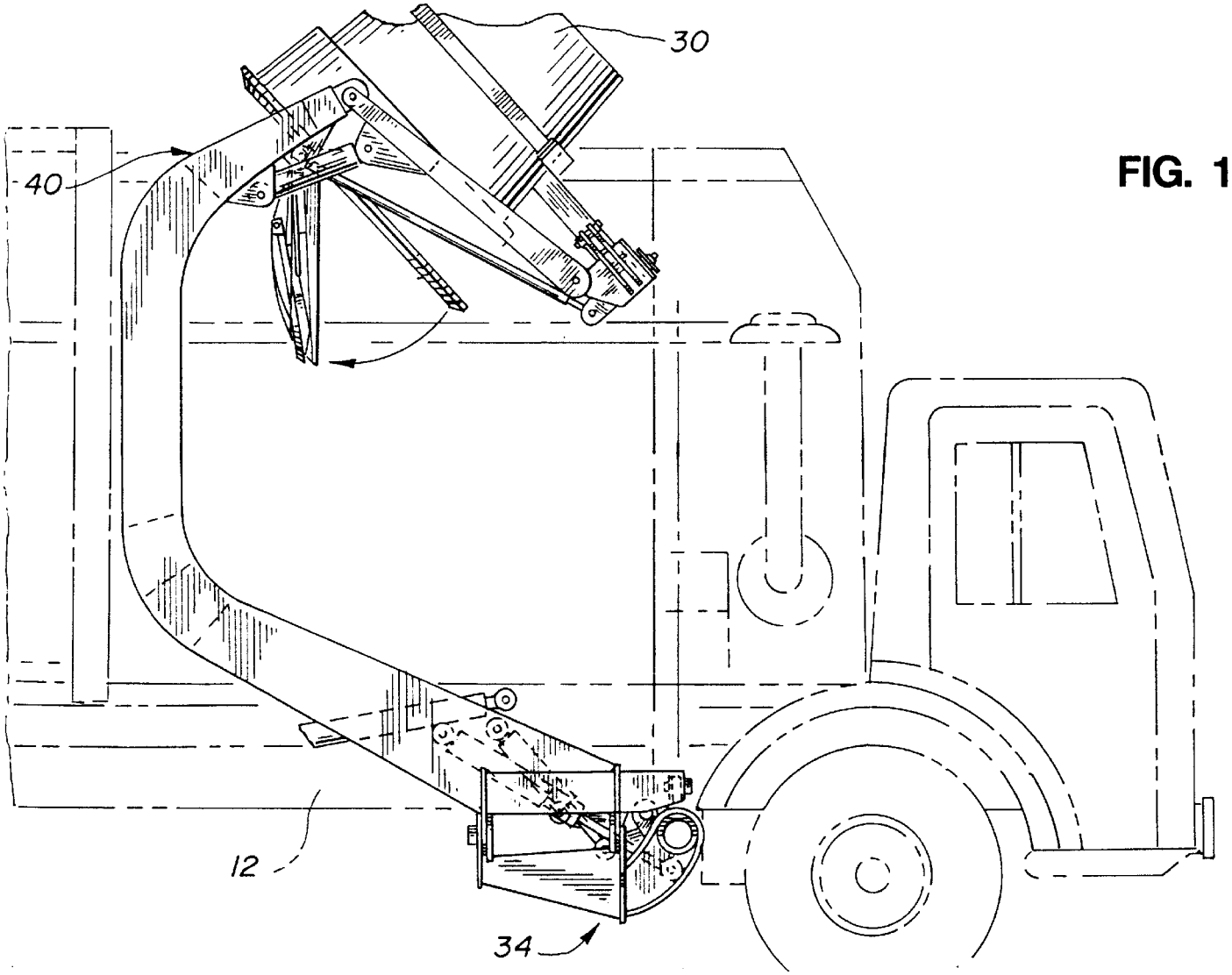
Figure 18:
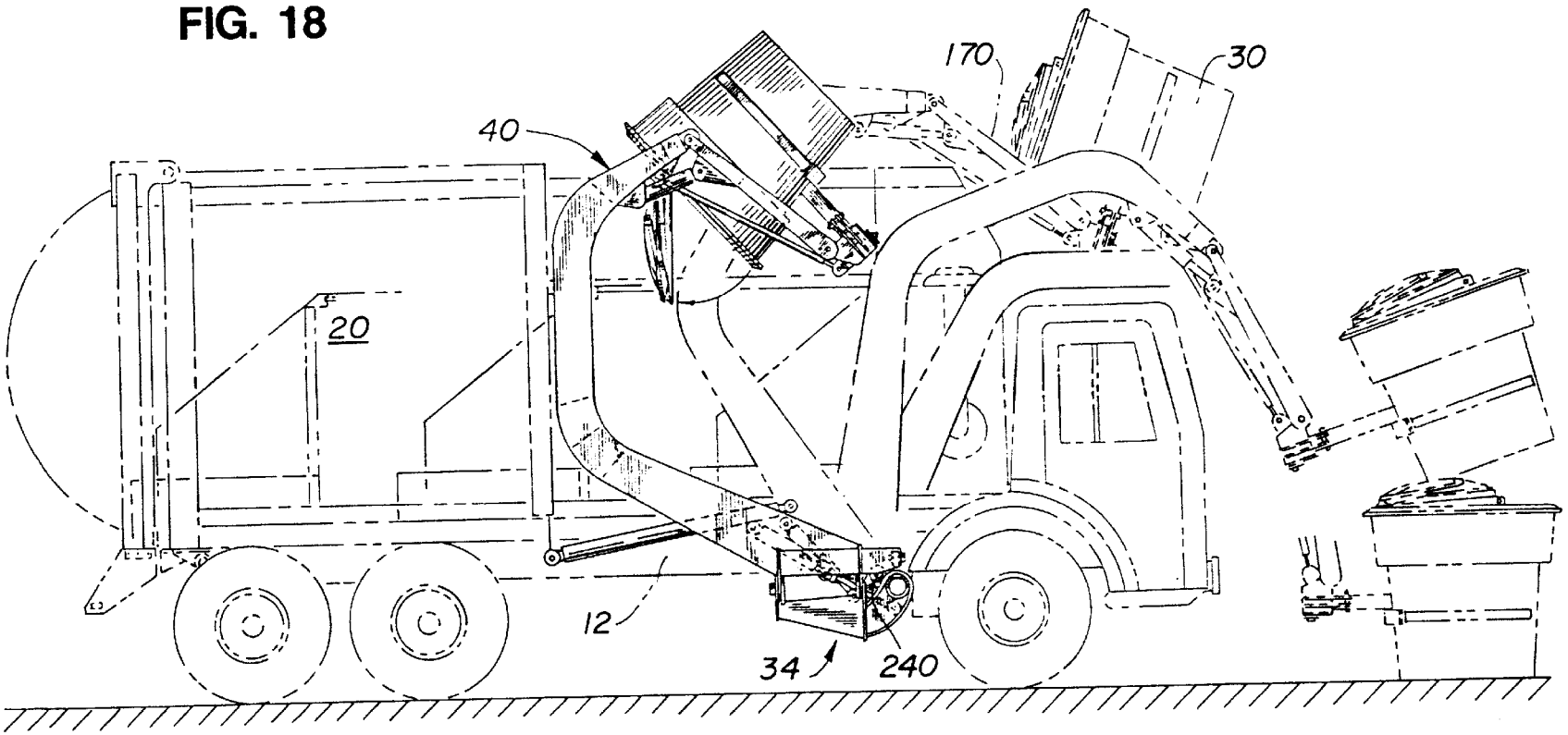
Figure 19:
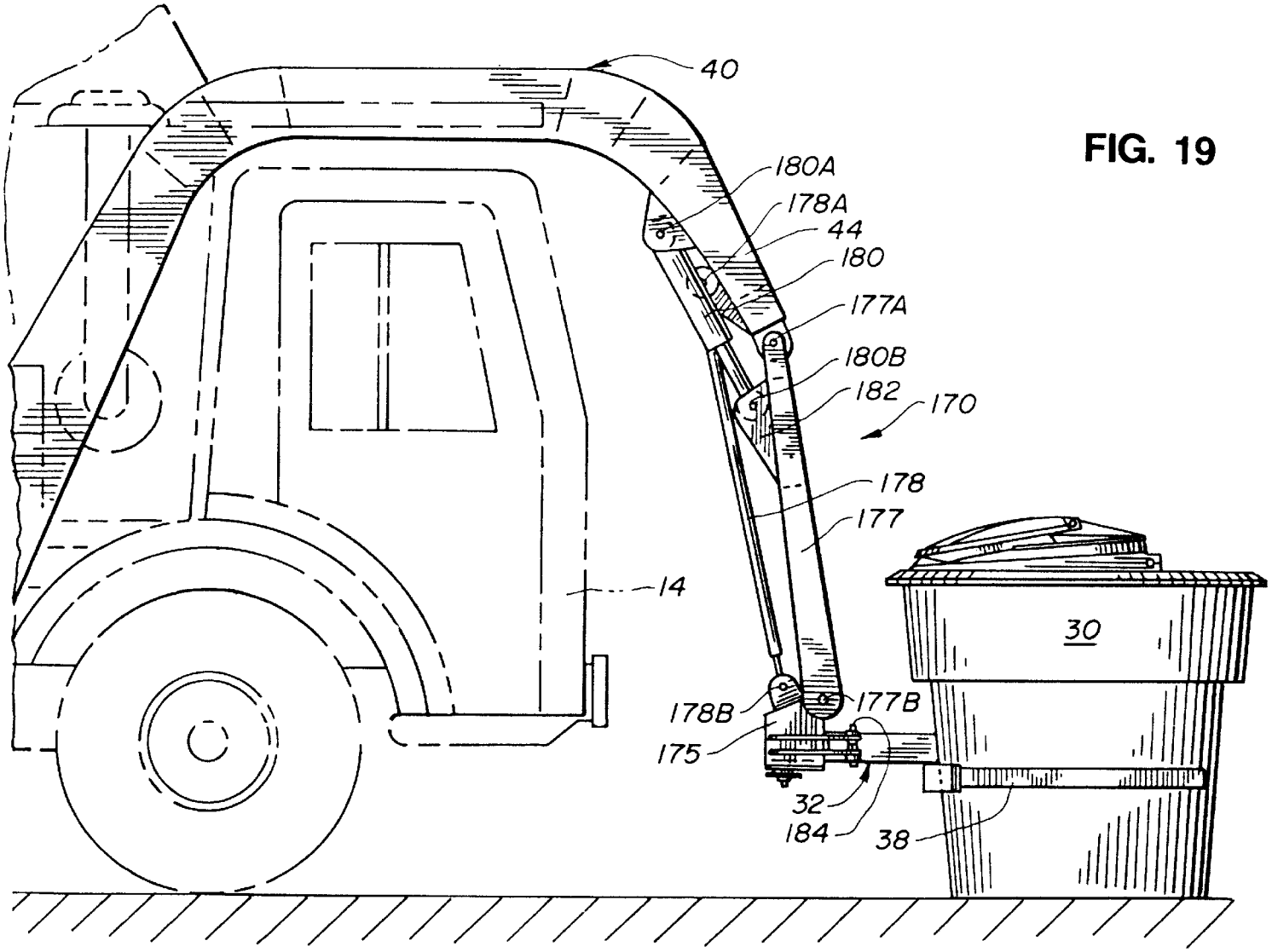
FIGS. 19–22 are exploded, side views of the four-bar linkage associated with the lift arm of the embodiment shown in FIGS. 14–18, illustrating the sequential operation of a portion of the lifting and loading assembly in raising a collection container to an off-load position.
Figure 22:
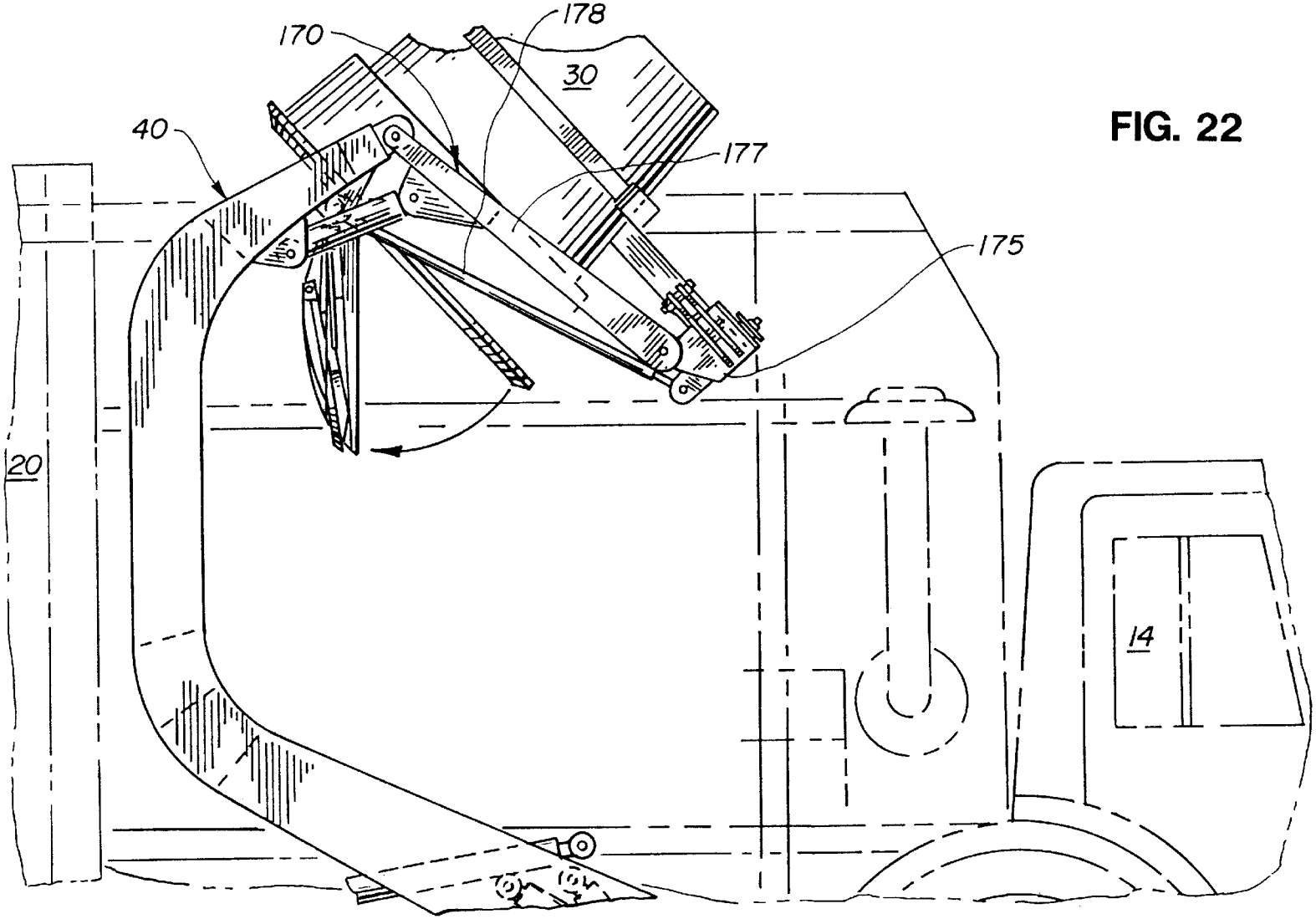

It will now be understood that the use of dump link 175 and the associated four-bar linkage described above provides an additional 45° of rotation for the container, permitting the container to be preferably dumped while it is being moved into position above the storage container, as shown in FIGS. 17, 18 and 22. Additionally, the novel use of dump link 175 in conjunction with the four-bar linkage as well as the orientation and pivotal location of lift arm 40, permit both the vertical container height and the height of left arm 40 to be minimized during tilting and dumping of the container (compare FIG. 5 with FIG. 17, for example), this configuration also permits the container to remain relatively level during movement from an initial resting location to about a cab-height location.

Figure 28:
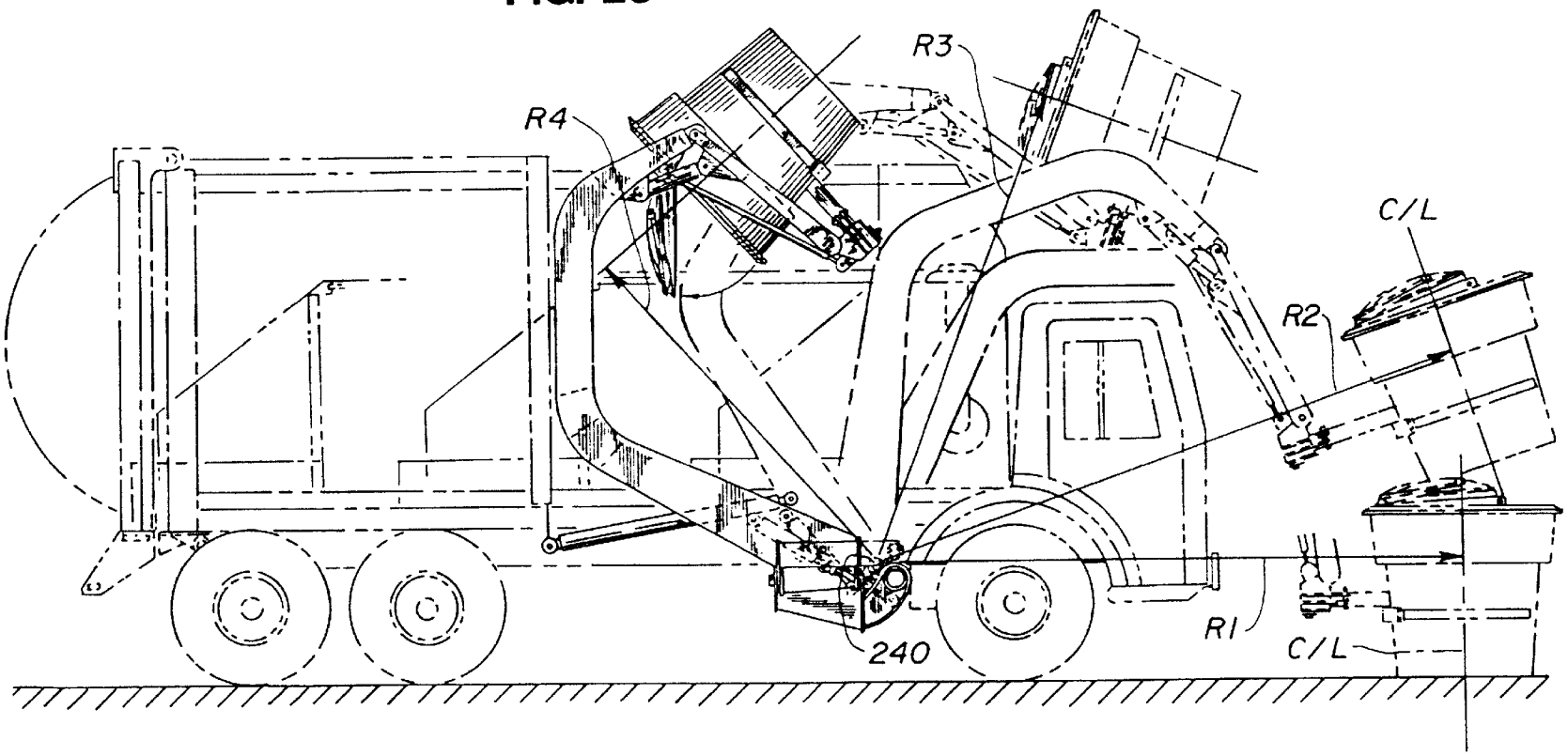
FIG. 28 is a view similar to FIG. 18 illustrating the variance in the distance between the lift arm priot point and the center line of the container, during movement of the container between load and off load locations.

Referring now to FIG. 28, "C/L" is pivot pin 177B 30, and each q, $R_1$–$R_4$ is the distance from main pivot 240 to pivot pin 177B (defined here as the "effective lift arm length or the effective length of the lift arm"). It can be seen that through the use of dump link 175 and the four-bar linkage described above, the effective lift arm length R preferably increases (although this is not necessary, as explained above) as the container moves from an initial ground-level position to an off-load position at approximately cab height (i.e., R2>R1); this increase is desireable to allow the container to remain substantially level during its initial movement, to avoid spillage. R then continually decreases as the container is tilted and then dumped (i.e., R2<R1 R3<R2 R4<R3). In this sense, the present invention defines a "low profile" refuse vehicle, since the effective lift arm length is minimized during tilting and dumping of the container.

EXPLANATION OF HYDRAULIC/ELECTRICAL CONTROLS FOR PARTICULARLY PREFERRED EMBODIMENT (FIG. 27)

The operation of the lift assembly described in FIGS. 14–26 will now be more particularly described, with reference to the fluid pressure circuits and the electrical circuit shown in FIG. 27. When the vehicle has been positioned adjacent to a container, the operator will move joystick W into the reach-out position, which supplies air to the actuator of the second spool of valve 2. This causes reach cylinder 250 to extend, swinging lift arm 32 curbside so that grabbers 38 are positioned adjacent the container. The operator then toggles the switch on top of joystick W to the right, energizing solenoid S3. Solenoid S3 then energizes air valve 4A, which shifts the third section in valve 2, extending grabber cylinder 166 and closing the grabbers about the container. The operator then pulls joystick W to the lower left-hand quadrant which actuates both the reach-in and lift-up movements of lift arm 32. Air flows to the second and fourth spools of valve 2. Reach cylinder 250 is contracted and, simultaneously, lift cylinder 220 is extended. Should the lift arm not be fully unreached when the lift arm is half-way up, valve 9 shifts, removing the air supply from the lift cylinder valve. The lift cylinder valve 220A comes back to neutral and the lift arm stops until the reach is all the way in. When the reach is fully in, valve 14 then shifts and air supply is again provided to the lift cylinder valve 220A causing lift cylinder 220 to extend. Also, when the reach is fully in, valve 9 shifts, shutting off the air supply to the reach cylinder valve 250A such that it comes back to neutral. At that point, full flow from the hydraulic pump is available to lift cylinder 220. When the operator has dumped the container, joystick W is then pushed forward to the lift down position. This provides air that actuates the lift cylinder valve section. Oil goes into the rod end of lift cylinder 220 and comes out the head end and returns to tank. The lift arm comes down, and the operator stops it in the desired position; simultaneously, the operator could have also moved joystick W to the reach-out position as the lift arm comes down, extending reach cylinder 250 and placing the container out further away from the truck chassis.

The lift mode has two speeds. Normally, lift cylinder 220 is in "full-time regeneration" ("the regen mode") which means that pressure is on both the head and the rod ends of the cylinder. Because of the difference in areas between the head and rod ends, lift cylinder 220 extends and the oil that comes out of the rod end is added to the head end. This effectively causes the cylinder to extend as though it had the bore of the rod diameter. The ratio of the base area to the rod area for the lift cylinder is approximately two to one (2:1). Thus, when the lift cylinder is lifting in the regen mode, it can move twice as fast but only lift half as much as when the lift cylinder is in the "normal" mode.

Shifting from the regen to the normal mode is accomplished as follows. Assuming that the lift capacity is 2,000 pounds, in the regen mode the capacity would be 1,000 pounds. Thus, if it takes 2,000 psi to lift 2,000 pounds in the normal mode, then in the regen mode it will take 2,000 psi to lift 1,000 pounds. That is because in the regen mode the area of the lift cylinder is effectively cut in half. Should the operator lift a container that is more than 1,000 pounds, shifting from the regen mode to the normal mode will occur automatically. As the operator attempts to pick up a 2,000 pound container in the regen mode, for instance, the pressure in the lift cylinder exceeds the maximum setting of 2,000 psi. At that point, pressure switch PS2 shifts. PS1 is also shifted as soon as the operator moves the joystick to the lift mode. Now, referring to the electrical circuit shown in FIG. 27, electricity flows from the battery, through the fuse, through the on-off switch, and PS1 is now shifted so there is electricity in the upper branch and normally no electricity will flow to coil CR. But, because the pressure is in excess of what is needed to lift the container in the regen mode, PS2 closes. This energizes relay coil CR and also solenoid S4. It also closes contact CR1 which keeps the coil energized even though pressure switch PS2 may again open. The relay solenoid coil and solenoid S4 remain energized until the operator places the joystick in some mode other than lift. When that happens, PS1 de-energizes and no electricity is available to energize coil CR. Now, when solenoid S4 is energized, the hydraulic circuit is placed in the normal mode in which the two ports of the directional control valve (2) are hooked up directly to the two ports of lift cylinder 220. The use of continuous regeneration also permits the lift assembly to be operated while the vehicle engine is in idle, which is more efficient (horsepower lower, less fuel used) and which increases the endurance of the engine and related components.

The operational controls for the master/slave dump cylinders 222, 180 will now be described. Master dump cylinder 222 is connected to the same cross shaft that is operated by lift cylinder 220. As the lift cylinder rotates the lift arm, master dump cylinder 222 is retracted and then extended. As the master dump cylinder extends, oil flows out of the rod end of the master dump cylinder directly into the rod end of slave dump cylinder 180. Oil from the head end of slave dump cylinder 180 flows into the head end of master dump cylinder 222. Therefore, these two dump cylinders stay in sequence. To assure that they stay in sequence, valving is used in between them and extra stroke is provided for the master dump cylinder. Thus, as the lift cylinder goes through its cycle, the slave dump cylinder comes to the end of its stroke about one half-inch before the master dump cylinder does. The oil is then pushed over the relief valve and is permitted to flow into the line that would go to tank or to feed the other cylinder through the check valve. This happens at both ends of the cycle, keeping the master/slave dump cylinders in sync every half-cycle.

The operational controls for the master/slave swing cylinders 224, 166 will now be described. These operate in the same manner as the master/slave dump cylinders. They can also be taken out of master/slave mode. Referring now to the electrical circuit shown in FIG. 27, solenoid S1 becomes energized when the operator in the cab flips a switch. This then shifts valve 4C which provides air that shifts valve 7. With valve 7 shifted, the first section of valve 2 can now operate slave swing cylinder 166 directly. This occurs manually through the use of a manual air valve 12 located within the cab. When valve 12 is pushed forward, the first spool in valve 2 shifts, causing slave swing cylinder 166 to be retracted. This gives the operator the ability to move pick-up arm 32 (normally positioned out to the side and in front of the truck) into a location in front of the truck. Pick-up arm 32 can move in a 90° arc, and the operator can stop pick-up arm 32 anywhere within this arc.

Following container engagement by grabbers 38, as the operator lifts the container, PS1 opens which de-energizes S1; this unshifts valve 7, placing the master/slave mode back into effect. This ensures that even though the operator has picked the container up with the lift arm oriented at some angle in between parallel with the truck and perpendicular to the truck, the lift arm will swing all the way in as the container is dumped. Following dumping, to return the container to its curbside location, PS1 is not energized and so solenoid S1 is again energized. This means that slave swing cylinder 166 will be in its fully closed position as the operator "unlifts" the container and returns the container to its original location. This ensures that the container will be returned directly in front of the truck rather than being placed along side of the truck (and possibly being inadvertently placed on top of an object such as a mailbox or a signpost).

ALTERNATIVE EMBODIMENTS

Any suitable structures known to those of ordinary skill in the art can be used to replace the various actuating and control mechanisms for the apparatus 28, described above, while providing the same or similar functions. In the illustrated embodiments, the mechanisms are actuated by fluid hydraulic pressure, and master/slave cylinders are employed. Alternatively, only "slave" cylinders need be employed and the "master" cylinders can be replaced with electronic controls. For example, electronic motion controls for open- and closed-center valves can be employed, such as the motion controls available from Commercial Intertech, Hydraulic Valve Division, of Hicksville, Ohio. (see Digitrak Catalog H-128). These controls employ an electronic reader which continuously monitors the cylinder lengths; a computer program directs the controls to selectively control the cylinders in a predetermined fashion, and as directed by the operator. Since the use of electronic controls can provide smoothly accelerating and decelerating movement for the lift and pick-up arms, cylinder cushions need not be used in this embodiment.

A proportional flow divider could also be used, so that a predetermined amount of the total flow splits off to the lift cylinder, and another predetermined portion of the total flow goes to the dump cylinder. This means a master cylinder need not be used, although dumping will commence immediately upon lifting.

Alternative structures are also available to replace the four-bar linkage. For example, a continuous cam track could be used instead of the four-bar linkage and the corresponding master/slave cylinders. In another alternative embodiment, the front link assembly could be controlled by a direct linkage to the vehicle or to the container, rather than being controlled by master/slave cylinders.

Of course, it should be understood that various changes and modifications to the disclosed preferred embodiments will be apparent to those skilled in the art. Such changes and modifications can be made without departing from the spirit and scope of the present invention and without diminishing its attendant advantages. It is, therefore, intended that such changes and modifications be covered by the following claims.

We claim:

1. A refuse collection vehicle for collecting refuse from one or more collection containers, comprising:

a cab and a storage container disposed rearwardly of the cab, the storage container having an inlet opening located at a front end of the storage container;

a lift arm assembly mounted at a first end portion located below a top portion of the cab and adapted to engage the collection container adjacent a second end portion;

a powered actuator for rotating the lift arm assembly about a first horizontal axis in a first rotational direction to move the lift arm assembly upwardly and rearwardly relative to the storage container between a load position at which the collection container is located near ground level, and an off-load position, in which the collection container is located adjacent the inlet opening;

wherein the lift arm assembly includes a low profile lift arm mechanism operatively associated with the lift arm assembly for rotating a portion of the lift arm assembly about at least a second horizontal axis, spaced from the first horizontal axis, in a rotational direction opposite that of the first rotational direction, and thereby adapted to reduce the effective length of the lift arm assembly as between the load and off-load positions.

2. The refuse collection vehicle of claim 1, further comprising a second powered actuator for pivoting the lift arm assembly about a vertical axis to permit the second end portion of the lift arm assembly to engage the collection container at a position laterally remote from the storage container and the cab.

3. The refuse collection vehicle of claim 1, further comprising a pick-up arm for engaging a refuse collection container, and a front link assembly rotatably associated with a front portion of the lift arm assembly and linking the lift arm assembly with the pick-up arm, the front link assembly operating to decrease the effective lift arm assembly length during tilting and dumping of the collection container, the front link assembly further comprising a front link arm pivotally connecting a first front portion of the lift arm assembly to a dump link, and a stabilizer arm pivotally connecting a second front portion of the lift arm assembly to the dump link, whereby the front link and stabilizer arms form a four-bar linkage which permits the collection container to be rotated relative to the lift arm assembly and facilitates the tilting and dumping of the collection container.

4. The refuse collection vehicle of claim 1, further comprising a pick-up arm connected to the second end portion of the lift arm assembly for engaging the collection container, an engaging mechanism operably disposed on the pick-up arm for holding the collection container, and a second powered actuator for moving the engaging mechanism with respect to the pick-up arm to a position for engaging the collection container.

5. The refuse collection vehicle of claim 1, further comprising a pick-up arm connected to the second end portion of the lift assembly for engaging the collection container and capable of pivoting about a generally vertical axis, wherein pivoting of the pick-up arm about the vertical axis occurs simultaneously and in synchronistic relationship with the upward and rearward movement of the lift arm assembly.

6. The refuse collection vehicle of claim 1, further comprising:

a pick-up arm connected to the second end portion of the lift arm assembly for engaging the collection container, the pick-up arm being capable of rotating about a generally vertical axis, and a disabling mechanism for selectively disabling the rotational movement of the pick-up arm about the generally vertical axis.

7. The refuse collection vehicle of claim 1, wherein the lift arm assembly is constructed and located so as to provide an operator located in the cab with a nonobstructed forward view from the cab to the collection container at the load position.

8. The refuse collection vehicle of claim 1, wherein the low profile lift arm mechanism ensures that neither the lift arm assembly nor the top of the container significantly protrudes above the top portion of the storage container during movement of the lift arm assembly between load and off-load positions.

9. The refuse collection vehicle of claim 1, wherein the lift arm assembly is a generally U-shaped assembly which includes an intermediate section joining the first and second portions, the intermediate section being positioned in part at an elevation above the cab, so that the lift arm assembly provides an operator located inside the cab with a generally nonobstructed view from the cab to the container.

10. The refuse collection vehicle of claim 1, further comprising a pick-up arm connected to the second end portion of the lift arm assembly for engaging a refuse collection container, wherein the pick-up arm rotates about a generally vertical axis simultaneous with the pivoting of the lift arm assembly about the first horizontal axis.

11. A refuse collection vehicle for collecting refuse from one or more collection containers, comprising:

a cab and a storage container disposed rearwardly of the cab, the storage container having an inlet opening located at a front end of the storage container;

a lift arm assembly mounted at a first end portion rearward of the cab and adapted to engage the collection container adjacent a second end portion;

a powered actuator for rotating the lift arm assembly about a first horizontal axis in a first rotational direction to move the lift arm assembly upwardly and rearwardly relative to the storage container between a load position at which the collection container is located near ground level, and an off-load position, in which the collection container is located adjacent the inlet opening;

wherein the lift arm assembly includes a low profile lift arm mechanism operatively associated with the lift arm assembly for rotating a portion of the lift arm assembly about at least a second horizontal axis, spaced from the first horizontal axis, in a rotational direction opposite that of the first rotational direction, and thereby adapted to reduce the effective length of the lift arm assembly as between the load a off-load positions.

12. A refuse collection vehicle for collecting refuse from one or more collection containers, comprising:

a cab and a storage container disposed rearwardly of the cab, the cab and the storage container each having a substantially equal and coextensive width;

the storage container having front and rear ends and an inlet opening located at its front end;

a lift arm assembly mounted at a first end portion rearward of the cab and adapted to engage the collection container adjacent a second end portion;

a powered actuator for rotating the lift arm assembly about a first horizontal axis in a first rotational direction to move the lift arm assembly upwardly and rearwardly relative to the storage container between a load position at which the collection container is located near ground level, and an off-load position, in which the collection container is located adjacent the inlet opening;

wherein the lift arm assembly includes a low profile lift arm mechanism operatively associated with the lift arm assembly for rotating a portion of the lift arm assembly about at least a second horizontal axis, spaced from the first horizontal axis, in a rotational direction opposite that of the first rotational direction, and thereby adapted to reduce the effective length of the lift arm assembly as between the load and off-load positions.

13. A method for employing a refuse collection vehicle having a cab and a storage container with an inlet opening positioned rearward of the cab, to engage a refuse collection container at a remote location laterally spaced from the vehicle, and for dumping the container contents and returning the collection container to its remote location, comprising the steps of:

a. providing a lift arm assembly having a first end pivotally mounted at a location below a top portion of the cab, and having a second end extending forward of the cab and having a mechanism associated with the second end of the lift arm assembly for engaging the collection container;

b. moving the lift arm assembly to permit engagement of the container at the remote location laterally spaced from the vehicle;

c. thereafter moving the lift arm assembly to transport the container to a location generally laterally in-line with the vehicle;

d. providing a powered actuator for rotating the lift arm assembly about a first horizontal axis in a first rotational direction to move the lift arm assembly upwardly and rearwardly relative to the storage container between a load position at which the collection container is located at the remote location, and an off-load position in which the collection container is located adjacent the inlet opening;

e. providing a low profile lift arm mechanism operatively associated with the lift arm assembly for rotating a portion of the lift arm assembly about at least a second horizontal axis, spaced from the first horizontal axis, in a rotational defection opposite that of the first rotational direction; and f. using the low profile lift arm mechanism to transport the collection container through a generally arcuate path of travel in which the collection container moves from the remote location to a position over the cab, and then to a position adjacent the inlet opening, with the effective length of the lift arm assembly decreasing as between the load and off-load positions.

14. The method of claim 13, wherein operation of the low profile lift arm mechanism automatically orients the collection container for dumping when the collection container is positioned adjacent the inlet opening.

15. The method of claim 13, wherein steps c. and f. are performed substantially simultaneously.

* * * * *